US007083890B2

(12) United States Patent
Emoto et al.

(10) Patent No.: US 7,083,890 B2
(45) **Date of Patent: *Aug. 1, 2006**

(54) TONER AND IMAGE FORMING APPARATUS USING THE TONER

(75) Inventors: Shigeru Emoto, Shizuoka (JP); Toshiki Nanya, Shizuoka (JP); Naohito Shimota, Shizuoka (JP); Maiko Kondo, Shizuoka (JP); Shinichiro Yagi, Shizuoka (JP); Hiroto Higuchi, Shizuoka (JP); Fumihiro Sasaki, Shizuoka (JP); Takahiro Honda, Shizuoka (JP); Junichi Awamura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 184 days.

This patent is subject to a terminal disclaimer.

(21) Appl. No.: 10/759,197

(22) Filed: Jan. 20, 2004

(65) Prior Publication Data

US 2004/0146795 A1 Jul. 29, 2004

(30) Foreign Application Priority Data

Jan. 20, 2003 (JP) ..... 2003-011680

(51) Int. Cl.
*G03G 9/087* (2006.01)

(52) U.S. Cl. ..... 430/109.4; 430/110.3; 430/110.4; 430/137.11; 430/137.15; 399/262; 399/263; 399/350

(58) Field of Classification Search ..... 430/109.4, 430/110.3, 110.4, 137.11, 137.15; 399/262, 399/263, 350

See application file for complete search history.

(56) References Cited

U.S. PATENT DOCUMENTS

| | | | | |
|---|---|---|---|---|
| 6,653,037 | B1 | 11/2003 | Sawada et al. | |
| 6,660,443 | B1 | 12/2003 | Sugiyama et al. | |
| 6,667,141 | B1 | 12/2003 | Iwamoto et al. | |
| 6,716,561 | B1 | 4/2004 | Shiraishi et al. | |
| 6,852,462 | B1 * | 2/2005 | Emoto et al. | 430/109.4 |

* cited by examiner

*Primary Examiner*—Mark A. Chapman
(74) *Attorney, Agent, or Firm*—Oblon, Spivak, McClelland, Maier & Neustadt, P.C.

(57) ABSTRACT

A toner is used in an image forming process employing a toner recycling system and contains at least a modified polyester resin, a coloring agent, and a releasing agent. The toner has a volume-average particle diameter Dv, a number-average particle diameter Dn and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200.

26 Claims, 8 Drawing Sheets

TONER AND IMAGE FORMING APPARATUS USING THE TONER

BACKGROUND OF THE INVENTION

1. Field of the Invention

The present invention relates to a toner for use in an image forming process utilizing, for example, electrophotography, electrostatic recording or electrostatic printing and using a toner recycling system; and to a developer, a toner container, an image forming apparatus (developing apparatus) and a process cartridge using the toner.

2. Description of the Related Art

In electrophotographic image formation, a latent image is electrostatically formed by charging and exposing on an image bearing member having a photoconductive layer of a photoconductive substance, the latent electrostatic image is developed using colored particles of toner to thereby form a visible toner image. The toner image is transferred to a transfer material such as a sheet of paper and is fixed thereon by action of, for example, heat, pressure or solvent evaporation to form an image output (copied image). Among various image fixing methods to fix a toner image known in the art, a heat roller fixing method is widely employed for high thermal efficiency and for image fixing at high speed. Basically, (1) a toner for use in the heat roller fixing method must be reliably fixed at low temperatures, that is, must have excellent image fixing properties at low temperatures, and (2) it must be resistant to migrating to the heat roller when it is fused in image fixing, that is, it must have excellent hot offset resistance. In addition, to form a sharp copied image, the toner must be stably present as a powder without aggregation during use or while being stored, that is, it must have excellent storage stability. To stably form good images without fogging in repetitive cycles, the toner must be resistant to crash or damage due to mechanical impact or pressure in a developing device.

Recently, more image forming apparatuses for developing a latent image formed on a photoconductor using a toner include a cleaner for removing residual toner on a photoconductor drum after transferring and a recycling device for recycling the toner removed by the cleaner to a developing device japanese Patent Application Laid-Open (JP-A) No. 60-41079). However, when a toner used in such an image forming apparatus using a recycling system may often invite a decreased image density, toner deposition on the background of images, fogging, and attachment of carrier particles with an increasing number of repetitive cycles of image formation. This is because the toner is deformed and broken by action of shearing force applied in a recycling process to have a decreased charge ability, and finely divided particles of the toner formed as a result of breaking reduces the charge imparting ability of the carrier. In monochrome copying systems which mainly employ an oil-less toner, a wax used as a releasing agent bleeds out from the surface of the toner particles by action of heat in an image forming apparatus or toner stress in cleaning or toner recycling system and adheres to the carrier to thereby invite a decreased charge.

Certain toners comprising a crosslinked polyester resin as a binder resin are used as a toner for use in a recycling system (JP-A No. 59-14144, No. 58-14147, No. 60-176049, No. 60-176054, No. 62-127748, and No. 62-127749). However, when these toners frequently receive mechanical external force due to, for example, stirring in a developing device as a result of recycling, they may be often broken to form fine powder, and the fine powder contaminates the carrier particles to decrease the charge ability of the carrier particles to thereby yield toner particles having an insufficient charge, and these toner particles then contaminate a developer carrying member or other components to decrease image developing properties.

To recycle toners satisfactorily, various investigations and improvements have been made on toners, image forming methods and image forming apparatus. For example, an attempt has been made to reuse a residual toner on an image bearing member after an image is transferred to an image-receiving member in an electrostatic image forming process. Such a residual toner has been stocked in, for example, a toner reclaim bottle, and the bottle has been discarded as an industrial waste. Such a discarded toner pollutes the environment and is a waste of resources. To avoid discarding of toners and to use all the toners, investigations have been made on toner recycling systems.

For example, JP-A No. 63-246780 discloses a technique in which a conveying path for conveying a recycled toner from a cleaner to a developing device is provided and the recycled toner is used as part of a toner feeding to the developing device. JP-A No. 01-118774 discloses a technique in which a cleaner is not used and a residual toner after transferring is recovered by a developing device. JP-A No. 06-51672 discloses a technique in which a chargeable rotating member is provided which recovers a toner by action of electrostatic force from a region of an image bearing member used for toner transfer and which releases the toner onto another region of the image bearing member not used for toner transfer.

However, these techniques each have defects and are not satisfactory. The technique disclosed in JP-A No. 63-246780 requires the conveying path of the toner such as a pipe and toner conveying means such as a screw or belt and thus invites a large-sized complicated apparatus. In the technique disclosed in JP-A No. 01-118774, a residual toner once adhered to an image bearing member cannot be significantly recovered in the developing device, thus adheres and attaches to the image bearing member, often resulting in toner deposition on the background of images or stained color portions due to insufficient exposure. This technique is not ready for abnormal circumstances such as paper jamming and may adversely affect subsequent processes after the toner adheres to the image bearing member. Various reports have been made in addition to the above descriptions, but are not satisfactory.

Based on strong demands for higher image quality, development of electrophotographic apparatus suitable for forming high-quality images and toner developers for use in the apparatus has increased. A toner for forming high-quality images preferably comprises spherical toner particles having a small particle diameter and a sharp (narrow) particle diameter distribution. Such toner particles having a sharp particle diameter distribution and a spherical shape behave in an identical manner in development to thereby significantly improve fine dot reproducibility.

However, such a conventional toner having a small particle diameter and a sharp particle distribution is not suitable for use in a recycling system. The toner cannot be sufficiently cleaned in the recycling system. In particular, it cannot be stably cleaned in blade cleaning. Under these circumstances, various techniques have been proposed on toners to improve the cleaning ability. For example, a technique for converting toner particles from spherical to irregular shape has been proposed, in which the flowability of the toner is decreased due to its irregular shape, and the irregular toner particles become easily stoppable with the blade. However, if the toner particles have excessively irregular shapes, the toner particles behave unstably in development to thereby decrease the fine dot reproducibility.

By converting the toner particles to have irregular shapes, the cleaning reliability is improved but image-fixing properties are deteriorated. Namely, the irregular-shaped toner particles are packed in a lower density in a toner layer on the transfer material before image fixing, and heat conducts in the toner layer at a lower speed in image fixing to thereby deteriorate image-fixing properties at low temperatures. In particular, when an image is fixed at a lower pressure, the heat conducts at a further lower speed to thereby inhibit image-fixing at low temperatures.

In contrast, JP-A No. 11-133665 discloses a toner having a Wadell practical sphericity of 0.90 to 1.00 and comprising a polyester. However, the toner is substantially spherical and cannot solve the cleaning problems.

Objects and Advantages

Under these circumstances, an object of the present invention is to provide a toner and a developer which can be used in a toner recycling system without deformation and breakdown, with less change in a surface of the toner, are free from decreased durability and quality, fogging, decreased image density, toner deposition on the background of images, and toner change with environment and can form images with good quality, as well as to provide an image forming apparatus and a detachable process cartridge using the toner.

Another object of the present invention is to provide a toner and a developer which can form images with high quality and excellent fine-dot reproducibility and can have high reliability in cleaning.

Yet another object of the present invention is to provide a toner and a developer which have excellent image-fixing properties at low temperatures.

Still another object of the present invention is to provide a toner and a developer which can satisfy all the above requirements.

A further object of the present invention is to provide a toner which has a high transfer efficiency, produces less residual toner after transfer and can form images with high quality.

SUMMARY OF THE INVENTION

The present inventors have found that the image-fixing properties at low temperatures can be improved by using a polyester resin as a main component of a binder resin of a toner. The present invention has been accomplished based on these and other findings.

Specifically, the present invention provides, in a first aspect, (1) a toner for use in an image forming process, comprising: a modified polyester resin; a coloring agent; a releasing agent; and a coating, wherein the toner has a volume-average particle diameter Dv, a number-average particle diameter Dn and a shape factor SF-1, wherein Dv is in a range of from 4.0 μm to 6.0 μm, the ratio Dv/Dn of Dv to Dn is in a range of from 1.00 to 1.30, and the shape factor SF-1 is in a range of from 140 to 200, and wherein the toner can be used in a toner recycling system.

In a second aspect, the present invention provides (2) a toner according to the first aspect (toner (1)), wherein the toner is produced by a process comprising the steps of: dissolving or dispersing a composition in an organic solvent to form a solution or dispersion, the composition comprising a resin reactive with a compound having an active hydrogen group, a coloring agent and a releasing agent; dispersing the solution or dispersion in an aqueous medium during at least one of elongation and crosslinking reactions of the resin thereby forming a reacted dispersion; and removing the organic solvent after or during at least one of the elongation and crosslinking reactions of the resin.

In a third aspect, the present invention provides (3) a toner according to the second aspect (toner (2)), wherein the composition further comprises a compound having an active hydrogen group.

In a fourth aspect, the present invention provides (4) a toner according to the second aspect (toner (2)), wherein the process further comprises the step of adding a compound having an active hydrogen group during the step of dispersing the solution or dispersion in the aqueous medium.

In a fifth aspect, the present invention provides (5) a toner according to the second aspect (toner (2)), wherein the aqueous medium comprises fine polymer particles, wherein the fine polymer particles are capable of forming a coating.

In a sixth aspect, the present invention provides (6) a toner according to the first aspect (toner (1)), wherein the ratio Dv/Dn is from 1.00 to 1.20.

In a seventh aspect, the present invention provides (7) a toner according to the first aspect (toner (1)), wherein the shape factor SF-1 is from 150 to 180.

In an eighth aspect, the present invention provides (8) a toner according to the first aspect (toner (1)), wherein the content percentage of particles having a diameter of 2 μm or less in a particle diameter distribution determined with a flow particle image analyzer is 15% by number or less.

In a ninth aspect, the present invention provides (9) a toner according to the first aspect (toner (1)), having an average sphericity of from 0.90 to 0.95 as determined with a flow particle image analyzer.

In a tenth aspect, the present invention provides (10) a toner according to the fifth aspect (toner (5)), wherein the fine polymer particles have a glass transition point Tg of from 50° C. to 110° C.

In an eleventh aspect, the present invention provides (11) a toner according to the fifth aspect (toner (5)), wherein the fine polymer particles comprise at least one resin selected from the group consisting of vinyl resins, polyurethane resins, epoxy resins, polyester resins, polyamide resins, polyimide resins, silicone resins, phenolic resins, melamine resins, urea resins, aniline resins, ionomer resins, and polycarbonate resins.

In a twelfth aspect, the present invention provides (12) a toner according to the fifth aspect (toner (5)), wherein the fine polymer particles have a volume average particle diameter of from 10 nm to 200 nm.

In a thirteenth aspect, the present invention provides (13) a toner according to the second aspect (toner (2)), wherein the process further comprises the step of agitating the reacted dispersion in an agitation vessel with an agitator having a peripheral speed of 5 m/ s or more to convert spherical particles into elliptic particles before the step of removing the organic solvent.

In a fourteenth aspect, the present invention provides (14) a toner according to the first aspect (toner (1)), wherein the modified polyester resin is a urea-modified polyester resin.

In a fifteenth aspect, the present invention provides (15) a toner according to the first aspect (toner (1)), further comprising an unmodified polyester resin.

In a sixteenth aspect, the present invention provides (16) a toner according to the first aspect (toner (1)), further comprising a polyester resin, wherein the polyester resin has a glass transition point Tg of from 40° C. to 70° C.

In a seventeenth aspect, the present invention provides (17) a toner according to the first aspect (toner (1)), further comprising a polyester resin, wherein the polyester resin has an acid value of from 1 mg-KOH/g to 30 mg-KOH/g.

In an eighteenth aspect, the present invention provides (18) a toner according to the first aspect (toner (1)), which is used in a two-component developer.

In a nineteenth aspect, the present invention provides (19) a two-component developer for use in an image forming process, comprising: a toner; and a carrier, wherein the toner contains: a modified polyester resin; a coloring agent; a releasing agent; and a coating, the toner having a volume-average particle diameter Dv, a number-average particle diameter. Dn, and a shape factor SF-1, wherein Dv is in a range from 4.0 μm to 6.0 μm, the ratio Dv/Dn of Dv to Dn is in a range from 1.00. to 1.30, and the shape factor SF-1 is in a range from 140 to 200, and wherein the developer can be used in a toner recycling system.

In a twentieth aspect, the present invention provides (20) an image forming apparatus, comprising: a photoconductor; a charger for charging the photoconductor; an exposer for exposing the photoconductor to light to form a latent electrostatic image; a developing unit containing a toner and serving for developing the latent electrostatic image using the toner to form a toner image; a transferring unit for transferring the toner image from the photoconductor to a transfer material; and a cleaner for cleaning a residual toner on the surface of the photoconductor with a blade after transfer, wherein the toner contains: a modified polyester resin; a coloring agent; a releasing agent; and a coating, the toner having a volume-average particle diameter Dv, a number-average particle diameter Dn, and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200.

In a twenty-first aspect, the present invention provides (21) an image forming apparatus according to the twentieth aspect (apparatus (20)), wherein the photoconductor is an amorphous silicon photoconductor.

In a twenty-second aspect, the present invention provides (22) an image forming apparatus according to the twentieth aspect (apparatus (20)), wherein the developing unit has an alternating electric field applying unit for applying an alternating electric field upon development of the latent electrostatic image on the photoconductor.

In a twenty-third aspect, the present invention provides (23) an image forming apparatus according to the twentieth aspect (apparatus (20)), wherein the charger comprises a charging member and the charger is so configured as to bring the charging member into contact with the photoconductor and apply a voltage to the charging member to thereby charge the photoconductor.

In a twenty-fourth aspect, the present invention provides (24) a process cartridge, integrally comprising: a photoconductor; and at least one selected from the group consisting of: a charger for charging the photoconductor; a developing unit containing a toner and serving for developing a latent electrostatic image using the toner to form a toner image; and a cleaner for cleaning a residual toner on the photoconductor with a blade after transfer, the process cartridge being detachable from and attachable to a main body of an image forming apparatus, wherein the toner contains: a modified polyester resin; a coloring agent; a releasing agent; and a coating, the toner having a volume-average particle diameter Dv, a number-average particle diameter Dn and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200.

In a twenty-fifth aspect, the present invention provides (25) an image forming process, comprising the steps of: charging a photoconductor; exposing the photoconductor to light to form a latent electrostatic image; developing the latent electrostatic image using a toner to form a toner image; transferring the toner image from the photoconductor to a transfer material; and cleaning a residual toner on the photoconductor with a blade after transferring, wherein the toner contains: a modified polyester resin; a coloring agent; a releasing agent; and a coating, the toner having a volume-average particle diameter Dv, a number-average particle diameter Dn and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200.

In a twenty-sixth aspect, the present invention provides (26) a toner for use in an image forming process, comprising: a modified polyester resin; a coloring agent; a release agent; and a plurality of fine polymer particles, wherein the surface of the toner is coated with the plurality of fine polymer particles, wherein the toner has a volume-average particle diameter Dv, a number-average particle diameter Dn and a shape factor SF-1, wherein Dv is in a range of from 4.0 μm to 6.0 μm, the ratio Dv/Dn of Dv to Dn is in a range of from 1.00 to 1.30, and the shape factor SF-1 is in a range of from 140 to 200, and wherein the toner can be used in a toner recycling system.

The present invention can provide a toner and a developer which can be recycled satisfactorily. In addition, by incorporating a two-component developer containing the toner of the present invention into an image forming apparatus of an oil-less image fixing system having a recycling system in which a recovered toner from a cleaning unit is recycled to a development unit, the resulting image forming apparatus can satisfactorily recycle the toner.

Further objects, features and advantages of the present invention will become apparent from the following description of the preferred embodiments with reference to the attached drawings.

DESCRIPTION OF THE PREFERRED EMBODIMENTS

Initially, the image forming method of the present invention will be illustrated with reference to the attached drawings.

Figure 1:
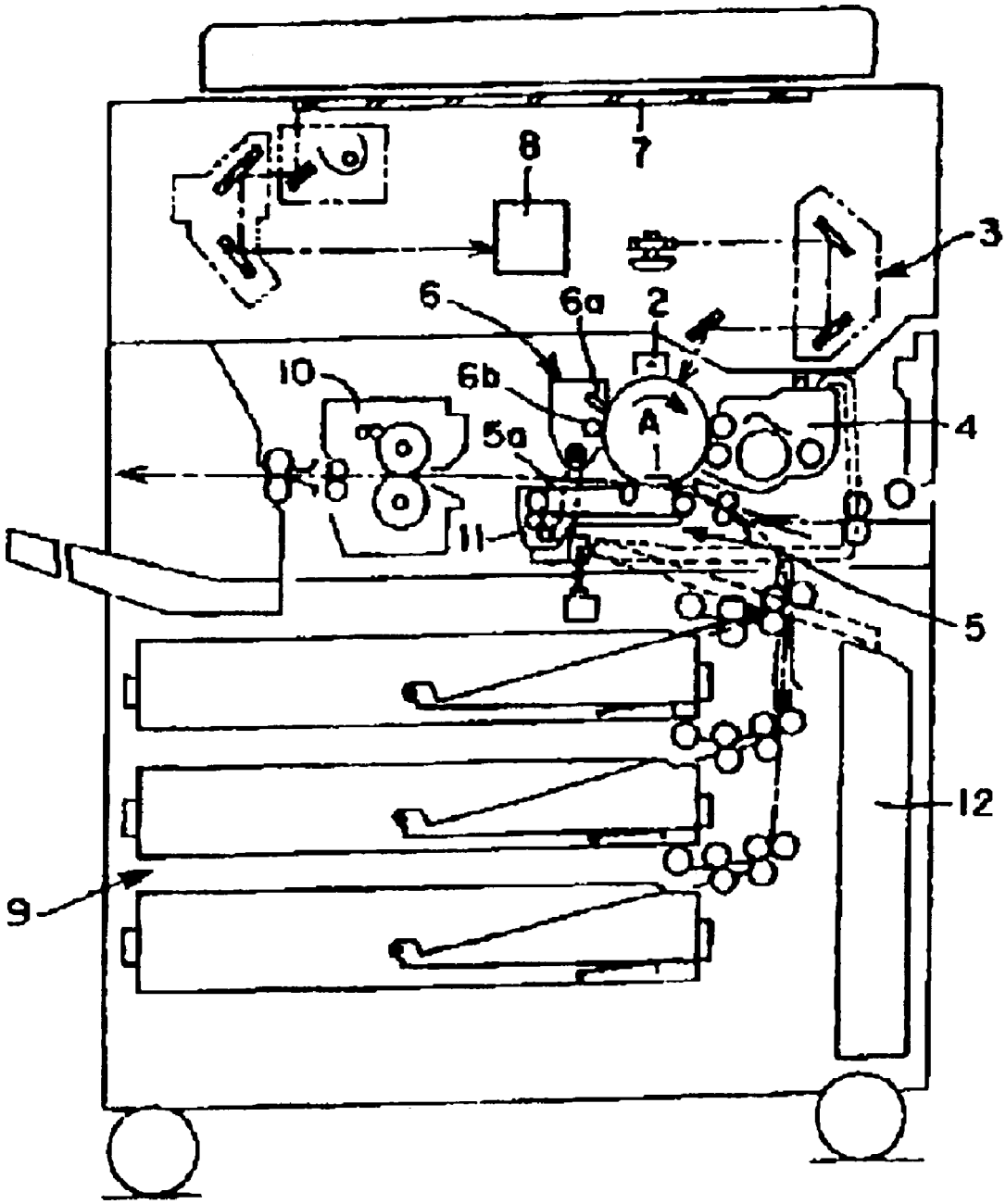
FIG. 1 is a schematic diagram of a digital copying machine as an example of image forming apparatus for use in the present invention.

FIG. 1 shows a digital copying machine as an example of image forming apparatus for use in the present invention. This type of apparatus, for example the IMAGIO NEO 751 digital copier manufactured by Ricoh Co., Ltd., employs an electrophotographic system well known in the art and is equipped with a drum photoconductor 1. Around the photoconductor 1 are arranged a charger 2, an exposing device 3, a development device 4, a transfer device 5 and a cleaning device 6 in a direction of rotation as indicated by the arrow A. A reader 8 reads an original placed on a document glass 7 on the top of the copying machine to form image signals, and the exposing device 3 forms a latent electrostatic image on the photoconductor 1 based on the image signals. The development device 4 develops the latent electrostatic image on the photoconductor 1 to form a toner image, and the transfer device 5 electrostatically transfer the toner image to a transfer sheet fed from a feeder 9. The transfer sheet bearing the toner image is conveyed to an image-fixing device 10, is fixed and is ejected out from the apparatus.

Figure 2:
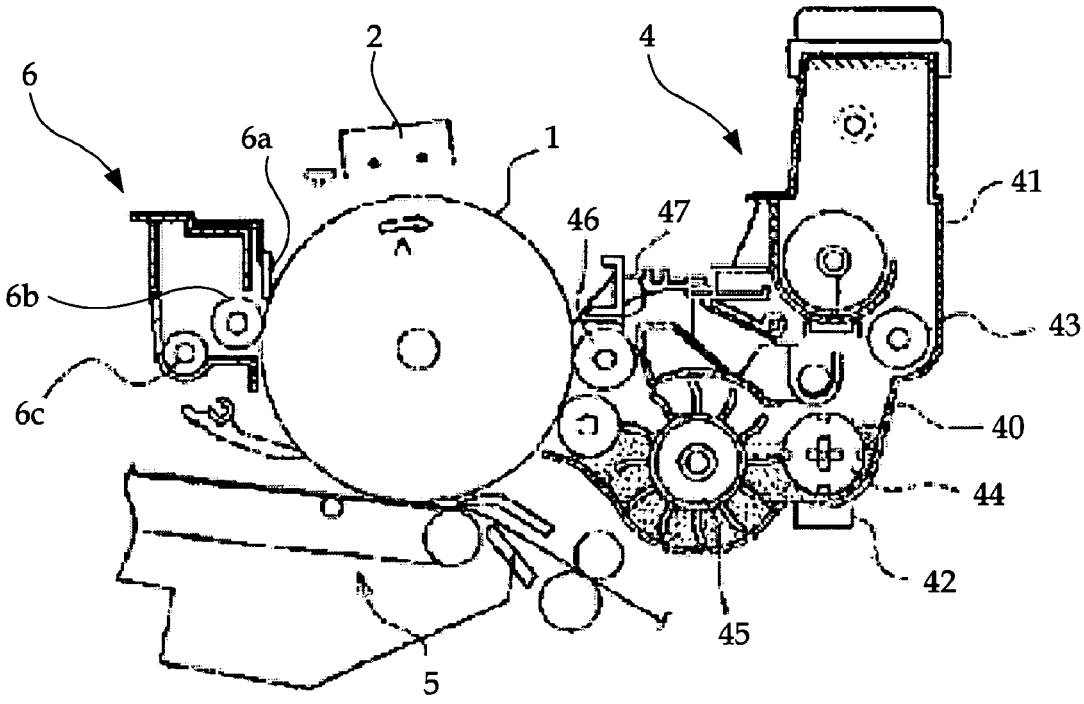
FIG. 2 is a schematic enlarged view of a principal part of the image forming apparatus as an example of the present invention.

The behavior of the toner in the image forming process will be illustrated with reference to FIGS. 1 and 2. The development device 4 is a two-component developing device having a development tank 40 including a developer comprising a carrier and the toner. The toner in the developer is consumed and the proportion thereof (toner concentration) decreases upon the formation of toner images by the development device 4. To avoid a decrease of image density, the toner is added from a toner hopper 41 to keep the toner concentration in the developer when a voltage Vt corresponding to the toner concentration in the developer reaches a predetermined level or more with respect to a reference voltage Vref corresponding to the target toner concentration, namely when the toner concentration reaches a predetermined level or less. The toner concentration in the developer is determined by a permeameter 42 mounted in a lower casing of the development device 4. The reference voltage Vref is set based on a voltage Vsp determined by measuring the voltage of a reference toner image (P pattern) forming on the photoconductor using a photosensor. The toner added from the toner hopper 41 via a feeding roller 43 is mixed with the carrier by stirring and is charged by friction by an agitating member 44 in the development device 4. The developer comprising the carrier and the toner is thrown up by a paddle wheel 45 to a development roller 46 and adheres to the development roller 46 by action of a magnet in the development roller 46. The developer is conveyed by a sleeve in the outer periphery of the development roller 46, and excess developer is scraped off by a development doctor blade 47. The toner in the developer conveyed to the photoconductor 1 adheres to the photoconductor 1 by action of a development bias in accordance with the latent electrostatic image.

Figure 3:
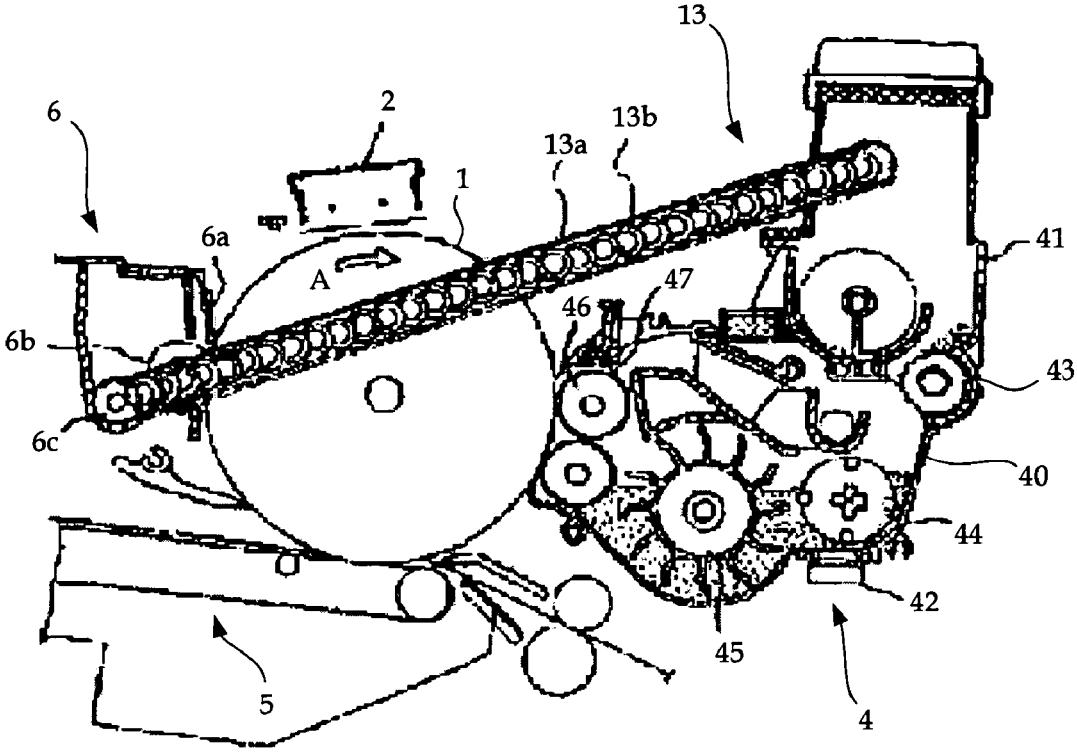
FIG. 3 is a schematic enlarged view of an example of a recycling device of the image forming apparatus of the present invention.

The toner adhered to the photoconductor 1 as a result of the development is electrostatically transferred to a transfer sheet by the transfer device 5, but about 10 percent of the toner is not transferred and remains on the photoconductor 1. To reuse as a recycled toner T, the untransferred toner is scraped off from the photoconductor 1 by a cleaning blade 6*a* and/or a brush roller 6*b* of the cleaning device 6. The recovered toner drops from an eject port 6*c* by its own weight and is conveyed to a conveying pipe 13*a* of a recycling device 13 as shown in FIG. 3. The recycling device comprises the conveying pipe 13*a* and a rotating screw conveyer 13*b* in the pipe 13*a*. The pipe 13*a* and screw 13*b* may be made of a metal such as aluminum or stainless steel, or a resin. The toner conveyed by the screw conveyer 13*b* is recycled to the development device 4 as a recycled toner.

Referring to FIG. 1, another cleaning device 11 is arranged adjacent to a transfer belt 5*a* of the transfer device 5, since the toner also adheres to the transfer belt 5*a* when the transfer belt 5*a* comes into contact with an untransferred part or non-image part of the photoconductor 1. The residual toner on the transfer belt 5*a* is scraped off by a cleaning blade (not shown) in contact with the transfer belt 5*a*. Since the scraped toner may possibly contain foreign matters such as paper dust, it is not recycled in this example. The scraped toner drops off from an eject port under its own weight and is conveyed via a toner guide screw pipe indicated by dotted lines to a waste toner tank 12 which is a toner reclaim container.

In the image forming apparatus having a toner recycling system which invites a lot of heat stress and mechanical stress, the toner of the present invention, which has a particle diameter and particle diameter distribution within a predetermined range, and which, in a preferable embodiment, may be produced in an aqueous medium dispersed with fine polymer particles so that toner particles therein are coated by the fine polymer particles, are significantly resistant to the above stress. More specifically, the fine polymer particles coating toner particles or the coating formed by the fine polymer particles can avoid decreased charge due to bleeding out of a wax serving as a releasing agent from the particle surface or due to adherence of the wax to the carrier. Generally, when a developer receives heat stress, the wax bleeds out from the toner surface, and the excessive wax adheres to the carrier surface. If the toner and the wax have the same polarity, the wax adhering to the carrier decreases the charge of the developer. In addition, recent demands to further improve image-fixing properties at low temperatures and to further increase precision and quality of images have resulted in toners having a smaller particle diameter, a sharper particle distribution and a lower softening point. These conventional toners further invite bleeding out of waxes in the toner recycling system, thus inviting more problems. In contrast, the toner according to the present invention also has a small particle diameter, a sharp particle distribution, a spherical shape, but can be cleaned satisfactorily and have good storage stability and releasing properties in spite of its low Tg to achieve image fixing at low temperatures more satisfactorily.

The toner of the present invention has a ratio Dv/Dn of a volume-average particle diameter Dv to a number-average particle diameter Dn of about 1.00 to about 1.30 and thereby exhibit a high resolution and high image quality. When the toner is used in a two-component developer, the average particle diameter of the toner in the developer less varies even after consumption and addition of the toner for a long time and can develop images satisfactorily and stably even after long-term agitation in a development device. If the ratio Dv/Dn exceeds 1.30, individual toner particles have largely different particle diameters and behave in different manners in development, and fine dots cannot be reproduced satisfactorily. Thus, high quality images are not obtained. For better images, the ratio Dv/Dn is preferably from 1.00 to 1.20.

The volume-average particle diameter Dv is preferably from about 4.0 μm to about 6.0 μm. It is generally believed that a smaller particle diameter of a toner can yield an image with a higher resolution and higher quality. However, an excessively small particle diameter adversely affects the transfer ability and cleaning ability.

If a toner having a volume-average particle diameter Dv less than about 4.0 μm is used in a two-component developer, the toner fuses and adheres to the carrier surface during long-term agitation in a development device to thereby decrease charge ability of the carrier. If such a toner is used in a one-component developer, the toner may invite filming to a development roller or adhesion to another member such as blade for thinning the toner layer. The content of fine powders in the toner significantly affects these phenomena. If the content of toner particles having a particle diameter of 3 μm or less exceeds 10%, the toner particles may adhere to the carrier or may not be charged stably at high level. If the volume-average particle diameter Dv of the toner exceeds about 6.0 mm, the toner may not significantly yield high-quality images with a high resolution and may often show large variation in its particle diameter after consumption and addition of the toner in the developer. This is also true if the ratio Dv/Dn exceeds 1.30.

The shape factor SF-1 of the toner is preferably from 140 to 200, since a toner having a small particle diameter and a sharp particle distribution may not be cleaned and recycled satisfactorily, as mentioned above.

The relationship between the toner shape and the transfer ability will be described below. In a full-color copying machine using multi-color development and transferring, the amount of a toner on a photoconductor increases as compared with a monochrome black toner for use in a monochrome copying machine, and cannot transfer more efficiently if a conventional irregular toner alone is used.

For well-balanced blade cleaning ability and transfer efficiency, the shape factor SF-1 is from 140 to 200, and preferably from 150 to 180. The cleaning ability and transfer ability vary depending on the material and position of the blade, and the transfer efficiency varies depending on the process conditions. Accordingly, the toner configuration can be designed according to the process, as far as it satisfies the above-specified shape factor SF-1. However, a toner having a shape factor SF-1 less than 140 may not be cleaned using a blade satisfactorily. A toner having a shape factor SF-1 exceeding 200 may not be transferred satisfactorily, as described above. This is because such a toner having an excessively irregular shape cannot be moved smoothly in transferring, for example, from a photoconductor to a transfer sheet, and constitutional toner particles behave in different manners and cannot be transferred efficiently and uniformly. In addition, such a toner is charged unstably, its constitutional particles are fragile to form fine powders in the developer to thereby decrease the durability of the developer.

The toner preferably has an elliptic shape as long as it has a shape factor SF-1 of from 140 to 200. Such an elliptic toner has less depressions and protrusions on its surface and can be transferred satisfactorily, next to a spherical toner. The elliptic toner has well-balanced properties and exhibits good cleaning ability and recycling ability which are trade-offs to the transfer ability. A toner having a substantially spherical shape may be satisfactorily transferred and conveyed in a recycling system, but it may not be cleaned well in a blade cleaning and cannot thereby be recycled.

In contrast, a toner having a shape factor SF-1 exceeding 200 will change its shape or form into fine powders during conveying, thus inviting charge failure or toner deterioration due to aggregation of fine powders.

Accordingly, the shape factor SF-1 is optimally from 140 to 200 in a recycling system. In this connection, conventional toners prepared by suspension polymerization or emulsion polymerization may not have satisfactorily controlled shapes, in contrast to the toner prepared according to the present invention employing a specific solvent removing process.

Toner Shape

The shape factor SF-1 used in the present invention to indicate the shape of the toner is a known factor and can be determined, for example, in the following manner. A sample toner is subjected to scanning electron microscopic (SEM) observation using a scanning electron microscope FE-SEM S-800 available from Hitachi, Ltd. to yield SEM images at a magnification of 500 times. One hundred of SEM images are randomly selected, and image information thereof is analyzed using an image analyzer (available from NIRECO Corporation, under the trade name of Luzex III). Then, the shape factor SF-1 is determined by calculation.

The toner for use in a recycling system must have a specific shape and a specific content of particles having a particle diameter of 2 μm or less as determined by a flow particle image analyzer for keeping high quality, high cleaning ability and recycling ability for a long time.

If a toner containing a large amount of fine particles is used in a two-component developer, the toner may fuse and adhere to the carrier surface during long-term agitation in a development device to thereby decrease charge ability of the carrier. If such a toner is used in a one-component developer, the toner may invite filming to a development roller or adhesion to another member such as blade for thinning the toner layer. To avoid these problems effectively, the amount of particles having a circle-equivalent-diameter (the diameter of a circle having the same area as the projected area of a particle) of 2.0 μm or less as determined by a flow particle image analyzer is preferably 15% by number or less. In addition, the resulting toner can be cleaned satisfactorily even after long-term repetitive use.

Such a particle diameter of a toner has been conventionally determined with a particle analyzer, for example, a Coulter Counter TA II (trade name, available from Beckman Coulter, Inc.) based on change in resistance in electric signals. Particle diameters of fine particles of 2 μm or less may not be determined precisely, due to noise using this type of instrument. In contrast, a flow particle image analyzer which determines particle profiles by image analysis can determine particle diameters of fine particles of 2 μm or less. The present inventors have found that, by reducing the content of fine particles (hereinafter referred to as "ultrafine toner particles") having a circle-equivalent-diameter as determined with a flow particle image analyzer of 2 μm or less, the toner becomes resistant to adhesion to a conveying system over a long period of time.

The average sphericity of the toner is preferably less than 0.95. When a toner has an average sphericity of 0.95 or more, i.e., containing a large amount of substantially spherical particles, such particles may not be cleaned satisfactorily over a long period of time in contact cleaning (blade cleaning).

The circle-equivalent-diameter and percentages by number for each range of sphericity in the present invention can be determined, for example, using a flow particle image analyzer FPIA-2100 (trade name, available from Sysmex Corporation). The outline of the analyzer and determination can be found in JP-A No. 08-136439. Specifically, the measurement is performed by adding 0.1 ml to 5 ml of a dispersing agent surfactant such as an alkylbenzene sulfonate to 50 ml to 100 ml of a 1% NaCl aqueous solution using a extra pure sodium chloride reagent from which solid impurities in the container has been previously removed by passing through a 0.45-μm filter, and then adding approximately 1 mg to 10 mg of a sample. The suspension containing the dispersed sample, is subjected to dispersion treatment for approximately 1 minute by a VS-150 tabletop ultrasonic washer (available from VELVO-CLEAR Co., Ltd.), and the toner shape is measured by the above apparatus at a dispersion concentration of 5000 particles per microliter to 15000 particles per microliter. The particle images are optically detected/analyzed with a CCD camera. For each particle image, a circle-equivalent-diameter is obtained by calculating a diameter of a circle having the same area as the area of the particle image. Then, for each diameter range, the number of particles is counted. Based on the precision of images of the CCD camera, a projected area diameter of 0.6 μm or more is set effective, and measured data of the particles are obtained. When a particle diameter is measured with a flow particle image analyzer, the precision of measurement of particles with a diameter of 2 μm or less is generally higher than the Coulter method.

Toner Particle Diameter

Generally, an average particle diameter, and a particle distribution of a toner are measured by a Coulter counter method. The Coulter counter method can be carried out with, for example, Coulter Counter TA-II and Coulter Multisizer II (trade names, available from Beckman Coulter, Inc.). In the present invention, an average particle diameter and a particle diameter distribution of a toner are determined by using the Coulter Counter TA-II connected to a personal computer PC 9801 (trade name, available from NEC Corporation).

The measurement will be described below.

Initially, 0.1 ml to 5 ml of a surfactant, preferably an alkylbenzenesulfonate, as a dispersing agent is added to 100 ml to 150 ml of an electrolyte. The electrolyte used herein is a near-1% aqueous solution of NaCl prepared from an extra pure (first grade) sodium chloride, and ISOTON-II NaCl solution (trade name, available from Beckman Coulter, Inc.) may be used, for example. Next, 2 mg to 20 mg of a test sample was added to the electrolytic solution. The electrolytic solution suspending the test sample was dispersed by an ultrasonic disperser for about 1 minute to 3 minutes. Thereafter, volume and number of toner particles were measured by the above-mentioned apparatus, i.e., the Coulter Counter TA-II (trade name, available from Beckman Coulter, Inc.) with an aperture of 100 μm, and volume particle distribution and number particle distribution were calculated thereby.

As channels, 13 channels of 2.00 μm to less than 2.52 μm; 2.52 μm to less than 3.17 μm; 3.17 μm to less than 4.00 μm; 4.00 μm to less than 5.04 μm; 5.04 μm to less than 6.35 μm; 6.35 μm to less than 8.00 μm; 8.00 μm to less than 10.08 μm; 10.08 μm to less than 12.70 μm; 12.70 μm to less than 16.00 μm; 16.00 μm to less than 20.20 μm; 20.20 μm to less than 25.40 μm; 25.40 μm to less than 32.00 μm; and 32.00 μm to less than 40.30 μm, were used. Here, the object was particles having a diameter range of 2.00 μm to less than 40.30 μm. Then, the volume-average particle diameter Dv based on the volume distribution and the number-average particle diameter Dn based on the number distribution of the toner are determined, and the ratio Dv/Dn of Dv to Dn is calculated.

Fine Polymer Particles

The fine polymer particles for use in the present invention preferably have a glass transition point Tg of from 50° C. to 110° C., more preferably from 50° C. to 90° C., and typically preferably from 50° C. to 70° C. Fine polymer particles having a glass transition point Tg less than 50° C. may give insufficient storage stability to the toner and may increase the probability of toner adhesion or aggregation in a toner-recovering path while recycling the toner. Fine polymer particles having a glass transition point Tg exceeding 110° C. may have decreased adhesion to a fixing sheet and elevate a lowest image fixing temperature.

The fine polymer particles have a weight-average molecular weight of preferably about $1\times10^5$ or less, and more preferably about $5\times10^4$ or less. The lower limit of the weight-average molecular weight is generally about 4000. Fine polymer particles having weight-average molecular weight exceeding about $1\times10^5$ may have decreased adhesion to a fixing sheet and elevate a lowest image fixing temperature.

The resin constituting the fine polymer particles can be any known resin, as long as it can form an aqueous dispersion, and can of such resins are vinyl resins, polyurethane resins, epoxy resins, and polyester resins. Each of these resins can be used alone or in combination. Among them, vinyl resins, polyurethane resins, epoxy resins, polyester resins, and mixtures of these resins are preferred since it is easy to prepare an aqueous dispersion of fine spherical polymer particles.

Examples of the vinyl resins are homopolymers or copolymers of vinyl monomers, such as styrene-(meth) acrylic ester resins, styrene-butadiene copolymers, (meth) acrylic acid-acrylic acid ester copolymers, styrene-acrylonitrile copolymers, styrene-maleic anhydride copolymers, and styrene-(meth)acrylic acid copolymers.

The volume average particle diameter of the fine polymer particles is preferably from 10 nm to 200 nm and more preferably from 20 nm to 80 nm. A light scattering spectrophotometer, such as the ones available from Otsuka Electronics Co., Ltd., can be used for the measurement of the volume average particle diameter.

Hot Offset Resistance

Various techniques for controlling the molecular weight distribution of a binder resin have been proposed for better hot offset resistance. To yield a toner having excellent low temperature image-fixing properties and hot offset resistance which are in a trade-off relation, for example, a binder resin having a broad molecular weight distribution is used, or a toner comprising a high-molecular weight component with a molecular weight on the order of several hundreds of thousands to several millions and a low-molecular weight fraction with a low molecular weight on the order of several thousands to several tens of thousands to obtain two functions. The high-molecular weight component is more effective to yield excellent hot offset resistance when it is crosslinked or is a gel.

The molecular weight distribution of the binder component (resin component) in the toner can be determined, for example, in the following manner.

About 1 g of a sample toner is precisely weighed in an Erlenmeyer flask and is mixed with 10 g to 20 g of tetrahydrofuran (THF) to yield a 5% to 10% binder solution in THF. A column is placed in a heat chamber at 40° C. to have a constant temperature, tetrahydrofuran THF as an eluent is fed at a flow rate of 1 ml/min to the column at 40° C. The sample solution in THF (20 μl) is injected into the column. The molecular weight of the sample is determined by calculation based on the logarithm of a calibration curve prepared by using monodispersed polystyrene reference samples. As the monodispersed polystyrene reference samples, for example, those having a molecular weight of $2.7\times10^2$ to $6.2\times10^6$ available from Tosoh Corporation can be used. A refractive index (RI) detector can be used as the detector. As the column, a combination of columns under trade names of TSK gel, G 1000H, G 2000H, G 2500H, G 3000H, G 4000H, G 5000H, G 6000H, G 7000H, and GMH can be used.

The THF-soluble resin component has a main peak molecular weight Mp of generally from 2500 to 10000, and preferably from 2500 to 8000. The storage stability at high temperatures may decrease with an increasing amount of a fraction having a molecular weight less than 2500. The image-fixing properties at low temperatures may deteriorate with an increasing amount of a fraction having a molecular weight exceeding 10000. However, the decrease of the image-fixing properties at low temperatures can be suppressed by balance control. A content of a fraction having a molecular weight exceeding 10000 varies depending on the material of the toner and is generally from 1% to 10%, and preferably from 3% to 6%. If the content is less than 1%, the toner may not have sufficient hot offset resistance. If it exceeds 10%, the toner may sometimes have insufficient glossiness and transparency. The content of a fraction having a molecular weight less than 2500 is, for example, from 0.1% to 5.0%.

The THF-soluble resin component has a number-average molecular weight Mn of preferably from 2000 to 15000 and a ratio Mw/Mn of the weight-average molecular weight Mw to Mn of preferably 5 or less. If the ratio Mw/Mn exceeds 5, the toner may not be melted sharply and may have insufficient gloss. The use of a polyester resin containing 1% to 25% of THF-insoluble component can yield higher hot offset resistance.

Binder Resin

Conventional materials can be used as the binder resin. Such conventional binder resins for use in toners include polyester resins, styrenic resins, acrylic resins, and epoxy resins, of which a resin comprising a copolymer of styrene and an acrylic ester is most widely used in regular toners. However, polyester resins which can satisfy the aforementioned thermal requirements are used in toners for image-fixing at low temperatures. Such polyester resins as binder resins have a low softening point and a high glass transition point, and the resulting toner can have excellent image-fixing properties at low temperatures and good storage stability. In addition, since the polyester resins have ester bonds having good affinity for paper, the toner has excellent offset resistance.

The polyester resin for use as a principal component of the binder resin of the toner according to the present invention can be prepared, for example, by condensation of an acid component and an alcohol component, by ring-opening of a cyclic ester, or by reaction of a halogen compound with an alcohol component and carbon monoxide. By polymerizing a combination of the monomers for the polyester resin, the toner of the present invention having the aforementioned excellent physical properties can be easily prepared. Such monomers for the polyester resin will be illustrated below.

Divalent or higher-valent compounds are preferably used as the alcohol component and the acid component. Examples of dihydric alcohols are ethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, and other diols; bisphenol A, hydrogenated bisphenol A, α,α'-bis(4-hydroxyphenyl)-1,4-diisopropylbenzene, polyoxyethylenated bisphenol A, polyoxypropylenated bisphenol A, and other alkylene oxide adducts of bisphenol A.

Examples of trihydric or higher alcohols include, for example, sorbitol, 1,2,3,6-hexanetetrol, 1,4-sorbitan, pentaerythritol, sucrose, 1,2,4-butanetriol, 1,2,5-pentanetriol, glycerol, 2-methylpropanetriol, 2-methyl-1,2,4-butanetriol, trimethylolmethane, trimethylolethane, trimethylolpropane, and 1,3,5-trihydroxymethylbenzene.

Examples of divalent acids are maleic acid, fumaric acid, citraconic acid, itaconic acid, glutaconic acid, phthalic acid, isophthalic acid, terephthalic acid, cyclohexanedicarboxylic acid, succinic acid, adipic acid, sebacic acid, azelaic acid, malonic acid, and other divalent organic acids. Examples of trivalent or higher acids are 1,2,4-benzenetricarboxylic acid, 1,2,5-benzenetricarboxylic acid, 1,2,4-cyclohexanetricarboxylic acid, 2,5,7-naphthalenetricarboxylic acid, 1,2,5-naphthalenetricarboxylic acid, 1,2,5-hexanetricarboxylic acid, 1,3-dicarboxy-2-methyl-2-carboxymethylpropane, tetrakis(carboxymethyl)methane, and 1,2,7,8-octanetetracarboxylic acid. Acid anhydrides and acid halides of these organic acids are also preferably used as the acid component.

Halogen compounds can be used as a compound corresponding to the acid component. Examples of the halogen compounds are compounds each having two or more halogen atoms, such as cis-1,2-dichloroethene, trans-1,2-dichloroethene, 1,2-dichloropropene, 2,3-dichloropropene, 1,3-dichloropropene, o-dichlorobenzene, m-dichlorobenzene, p-dichlorobenzene, o-dibromobenzene, m-dibromobenzene, p-dibromobenzene, o-chlorobromobenzene, dichlorocyclohexane, dichloroethane, 1,4-dichlorobutane, 1,8-dichlorooctane, 1,7-dichlorooctane, dichloromethane, 4,4'-dibromovinylphenol, and 1,2,4-tribromobenzene.

At least one of the acid component and the alcohol component for the polyester resin preferably has an aromatic ring.

The ratio of the alcohol component to the acid component is such that the amount of alcohol groups is preferably from 0.9 to 1.5 mole equivalent, and more preferably from 1.0 to 1.3 mole equivalent relative to 1 mole equivalent of carboxyl groups. The term "carboxyl group" as used herein also includes halogen atoms of the halogen compound corresponding to the acid component. The material for the polyester resin may further comprise an amine component, such as triethylamine, trimethylamine, and N,N-dimethylaniline. Another condensing agent such as dicyclohexylcarbodiimide can also be used in the reaction.

Modified Polyester Reactive with Active Hydrogen Group The reactive modified polyester resin reactive with an active hydrogen group (RMPE) (hereinafter the polyester resin may be simply referred to as "polyester") includes, for example, polyester prepolymers having a functional group reactive with an active hydrogen group such as isocyanate group. An isocyanate-containing polyester prepolymer (A) is suitably used in the present invention. The isocyanate-containing polyester prepolymer (A) can be prepared by allowing a polyester as a polycondensate between a polyhydric alcohol (PO) and a polycarboxylic acid (PC) having an active hydrogen group to react with a polyisocyanate compound (PIC). The active hydrogen group of the polyester includes, for example, hydroxyl groups (alcoholic hydroxyl groups and phenolic hydroxyl groups), amino groups, carboxyl groups, and mercapto groups, of which alcoholic hydroxyl groups are preferred.

Examples of the polyol include diols (DIO) and trihydric or higher polyols (TO). As the polyol (PO), a diol (DIO) alone or a mixture of a diol (DIO) and a small amount of a polyol (TO) is preferred.

Examples of the diols include alkylene glycols such as ethylene glycol, 1,2-propylene glycol, 1,3-propylene glycol, 1,4-butanediol, and 1,6-hexanediol; alkylene ether glycols such as diethylene glycol, triethylene glycol, dipropylene glycol, polyethylene glycol, polypropylene glycol, and polytetramethylene ether glycol; alicyclic diols such as 1,4-cyclohexanedimethanol, and hydrogenated bisphenol A; bisphenols such as bisphenol A, bisphenol F, and bisphenol S; alkylene oxide (e.g., ethylene oxide, propylene oxide, and butylene oxide) adducts of the aforementioned alicyclic diols; and alkylene oxide (e.g., ethylene oxide, propylene oxide, and butylene oxide) adducts of the aforementioned bisphenols. Among them, alkylene glycols having 2 to 12 carbon atoms, and alkylene oxide adducts of bisphenols are preferred, of which alkylene oxide adducts of bisphenols alone or in combination with any of alkylene glycols having 2 to 12 carbon atoms are typically preferred.

The trihydric or higher polyols include, for example, trihydric or higher aliphatic alcohols such as glycerol, trimethylolethane, trimethylolpropane, pentaerythritol, and sorbitol; trihydric or higher phenols such as trisphenol PA, phenol novolacs, and cresol novolacs; and alkylene oxide adducts of these trihydric or higher polyphenols.

The polycarboxylic acid (PC) includes, for example, dicarboxylic acids (DIC) and tri- or higher polycarboxylic acids (TC). As the polycarboxylic acid (PC), a dicarboxylic acid (DIC) alone or in combination with a small amount of a tri- or higher polycarboxylic acid (TC) is preferred.

The dicarboxylic acids include, but are not limited to, alkylenedicarboxylic acids such as succinic acid, adipic acid, and sebacic acid; alkenylenedicarboxylic acids such as maleic acid, and fumaric acid; aromatic dicarboxylic acids such as phthalic acid, isophthalic acid, terephthalic acid, and naphthalenedicarboxylic acid. Among them, preferred are alkenylenedicarboxylic acids each having 4 to 20 carbon atoms and aromatic dicarboxylic acids each having 8 to 20 carbon atoms.

The tri- or higher polycarboxylic acids include, for example, aromatic polycarboxylic acids each having 9 to 20 carbon atoms, such as trimellitic acid and pyromellitic acid. An acid anhydride or lower alkyl ester (e.g., methyl ester, ethyl ester, and propyl ester) of any of the polycarboxylic acids can be used as the polycarboxylic acid to react with the polyol.

The polyisocyanate (PIC) includes, but is not limited to, aliphatic polyisocyanates such as tetramethylene diisocyanate, hexamethylene diisocyanate, and 2,6-diisocyanatomethyl caproate; alicyclic polyisocyanates such as isophorone diisocyanate, and cyclohexylmethane diisocyanate; aromatic diisocyanates such as tolylene diisocyanate, and diphenylmethane diisocyanate; aromatic-aliphatic diisocyanates such as $\alpha,\alpha,\alpha',\alpha'$-tetramethylxylylene diisocyanate; isocyanurates; blocked products of the polyisocyanates with, for example, phenol derivatives, oximes, or caprolactams; and mixtures of these compounds.

The molar ratio [NCO]/[OH] of isocyanate groups [NCO] to hydroxyl groups [OH] of the hydroxyl-containing polyester is generally from 5/1 to 1/1, preferably from 4/1 to 1.2/1, and more preferably from 2.5/1 to 1.5/1. If the ratio [NCO]/[OH] exceeds 5, the toner may have insufficient image-fixing properties at low temperatures. If the ratio [NCO]/[OH] is less than 1, a urea content in the modified polyester decreases, and the toner may have deteriorated hot offset resistance. The content of the polyisocyanate (PIC) in the prepolymer (A) having an isocyanate group is generally from 0.5% to 40% by weight, preferably from 1% to 30% by weight, and more preferably from 2% to 20% by weight. If the content is less than 0.5% by weight, the hot offset resistance may deteriorate, and satisfactory storage stability at high temperatures and image-fixing properties at low temperatures may not be obtained concurrently. If the content exceeds 40% by weight, the image-fixing properties at low temperatures may deteriorate.

The isocyanate-containing polyester prepolymer (A) generally has, in average, 1 or more, preferably 1.5 to 3, and more preferably 1.8 to 2.5 isocyanate groups per molecule. If the amount of the isocyanate group per molecule is less than 1, the resulting urea-modified polyester may have a low molecular weight and the hot offset resistance may deteriorate.

By allowing the isocyanate-containing polyester prepolymer (A) to react with an amine (B), a urea-modified polyester (UMPE) can be prepared. The urea-modified polyester (UMPE) effectively and advantageously serves as a toner binder.

The amine (B) includes, for example, diamines (B1), tri- or higher polyamines (B2), amine alcohols (B3), aminomercaptans (B4), amino acids (B5), and amino-blocked products (B6) of the amines (B1) to (B5). The diamines (B1) include, but are not limited to, aromatic diamines such as phenylenediamine, diethyltoluenediamine, and 4,4'-diaminodiphenylmethane; alicyclic diamines such as 4,4'-diamino-3,3'-dimethyldicyclohexylmethane, diaminocyclohexanes, and isophoronediamine; and aliphatic diamines such as ethylenediamine, tetramethylenediamine, and hexamethylenediamine. The tri- or higher polyamines (B2) include, for example, diethylenetriamine, and triethylenetetramine. The amino alcohols (B3) include, but are not limited to, ethanolamine, and hydroxyethylaniline. The aminomercaptans (B4) include, for example, aminoethyl mercaptan, and aminopropyl mercaptan. The amino acids (B5) include, but are not limited to, aminopropionic acid, and aminocaproic acid. The amino-blocked products (B6) of the amines (B1) to (B5) includes ketimine compounds and oxazoline compounds derived from the amines (B1) to (B5) and ketones such as acetone, methyl ethyl ketone, and methyl isobutyl ketone. Among these amines (B), preferred are the diamine (B1) alone or in combination with a small amount of the polyamine (B2).

Where necessary, the molecular weight of the modified polyester can be controlled by using an elongation terminator. Such elongation terminators include, but are not limited to, monoamines, such as diethylamine, dibutylamine, butylamine, and laurylamine; and blocked products thereof (ketimine compounds).

The content of the amine (B) in terms of the equivalence ratio [NCO]/[NHx] of isocyanate groups [NCO] in the polyester prepolymer (A) to amino groups [NHx] of the amine (B) is generally from 1/2 to 2/1, preferably from 1.5/1 to 1/1.5 and more preferably from 1.2/1 to 1/1.2. If the ratio [NCO]/[NHx] exceeds 2/1 or is less than 1/2, the urea-modified polyester may have a low molecular weight, and the hot offset resistance may deteriorate. The urea-modified polyester for use in the present invention may have a urethane bond in addition to the urea bond. The molar ratio of the urea bond to the urethane bond is generally from 100/0 to 10/90, preferably from 80/20 to 20/80, and more preferably from 60/40 to 30/70. If the molar ratio of the urea bond to the urethane bond is less than 10/90, the hot offset resistance may deteriorate.

The amine (B) serves as a crosslinking agent and/or elongation agent for the reactive modified polyester.

The urea-modified polyester for use in the present invention can be prepared, for example, by a one-shot method or a prepolymer method. The weight-average molecular weight of the modified polyester such as the urea-modified polyester is generally $1\times10^4$ or more, preferably from $2\times10^4$ to $1\times10^7$, and more preferably from $3\times10^4$ to $1\times10^6$. If the weight-average molecular weight is less than $1\times10^4$, the hot offset resistance may deteriorate. The number-average molecular weight of the modified polyester is not specifically limited when an unmodified polyester mentioned later is used in combination and may be such a number-average molecular weight as to yield the above-specified weight-average molecular weight. If the modified polyester is used alone, the number-average molecular weight thereof is generally 20000 or less, preferably from 1000 to 10000, and more preferably from 2000 to 8000. If the number-average molecular weight exceeds 20000, the image-fixing properties at low temperatures and glossiness upon use in a full-color apparatus may deteriorate.

Unmodified Polyester In the present invention, the modified polyester (MPE) can be used alone or in combination with an unmodified polyester (PE) as the binder resin component of the toner. The combination use of the modified polyester (MPE) with the unmodified polyester (PE) may improve the image-fixing properties at low temperatures and glossiness upon use in a full-color apparatus and is more preferred than the use of the modified polyester alone. The unmodified polyester (PE) and preferred examples thereof include, for example, polycondensation products of a polyol and a polycarboxylic acid as in the polyester component of the modified polyester (MPE). The unmodified polyesters (PE) include unmodified polyesters as well as polyesters modified with a urethane bond or another chemical bond other than urea bond. The modified polyester (MPE) and the unmodified polyester (PE) are preferably at least partially compatible or miscible with each other for better image-fixing properties at low temperatures and hot-offset resistance. Accordingly, the modified polyester (MPE) preferably has a polyester component similar to that of the unmodified polyester (PE). The weight ratio of the modified polyester (MPE) to the unmodified polyester (PE) is generally from 5/95 to 80/20, preferably from 5/95 to 30/70, more preferably from 5/95 to 25/75, and typically preferably from 7/93 to 20/80. If the weight ratio is less than 5/95, the hot offset resistance may deteriorate, and satisfactory storage stability at high temperatures and image fixing properties at low temperatures may not be obtained concurrently.

The peak molecular weight of the unmodified polyester (PE) is generally from 1000 to 30000, preferably from 1500 to 10000, and more preferably from 2000 to 8000. If the peak molecular weight is less than 1000, the storage stability at high temperatures may deteriorate, and if it exceeds 30000, the image-fixing properties at low temperatures may deteriorate. The hydroxyl value of the unmodified polyester (PE) is preferably 5 or more, more preferably from 10 to 120, and typically preferably from 20 to 80. If the hydroxyl value is less than 5, satisfactory storage stability at high temperatures and image-fixing properties at low temperatures may not be obtained concurrently. The acid value of the unmodified polyester (PE) is generally from 1 to 30 mg-KOH/g, and preferably from 5 to 20 mg-KOH/g. A binder having such an acid value may be negatively charged. The glass transition temperature of the unmodified polyester (PE) is preferably from 40 ° C. to 70 ° C., although a PE having a glass transition temperature outside this range may be used.

The glass transition point Tg of the toner binder for use in the present invention is generally from 50° C. to 70° C., and preferably from 55° C. to 65° C. If the glass transition point is less than 50° C., the heat storage stability of the toner may deteriorate, and if it exceeds 70° C., the image-fixing properties at low temperatures may be insufficient. By using the urea-modified polyester resin, the dry toner according to the present invention, even with a low glass transition point, shows higher heat storage stability than conventional polyester toners. The storage elastic modulus of the toner binder is such that the temperature TG', at which the storage elastic modulus determined at 20 Hz is 10000 dyne/$cm^2$, is generally 100° C. or higher, and preferably from 110° C. to 200° C. If the temperature TG' is lower than 100° C., the hot offset resistance may deteriorate. The temperature Tη), at which the viscosity of the toner binder is 1000 poises as determined at 20 Hz, is generally 180° C. or lower, and preferably from 90° C. to 160° C. If the temperature Tη exceeds 180° C., the image-fixing properties at low temperatures may deteriorate. To obtain satisfactory image-fixing properties at low temperatures and hot offset resistance concurrently, TG' is preferably higher than Tη. In other words, the difference between TG' and Tη (TG'−Tη) is preferably 0 degrees or more, more preferably 10 degrees or more, and typically preferably 20 degrees or more. The upper limit of the difference is not specifically limited. To obtain satisfactory heat storage stability and image-fixing properties at low temperatures concurrently, the difference between Tη and Tg is preferably from 0° C. to 100° C., more preferably from 10° C. to 90° C., and typically preferably from 20° C. to 80° C.

Colorant

Any conventional or known dyes and pigments can be used as the colorant of the present invention. Such dyes and pigments include, but are not limited to, carbon black, nigrosine dyes, black iron oxide, Naphthol Yellow S, Hansa Yellow (10G, 5G, and G), cadmium yellow, yellow iron oxide, yellow ochre, chrome yellow, Titan Yellow, Polyazo Yellow, Oil Yellow, Hansa Yellow (GR, A, RN, and R), Pigment Yellow L, Benzidine Yellow (G, GR), Permanent Yellow (NCG), Vulcan Fast Yellow (5G, R), Tartrazine Lake, Quinoline Yellow Lake, Anthragen Yellow BGL, isoindolinone yellow, red oxide, red lead oxide, red lead, cadmium red, cadmium mercury red, antimony red, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof.

The content of the colorant is generally from 1% by weight to 15% by weight, and preferably from 3% by weight to 10% by weight of the toner.

A colorant for use in the present invention may be a master batch prepared by mixing and kneading a pigment with a resin. Examples of binder resins for use in the production of the master batch or in kneading with the master batch are, in addition to the aforementioned modified and unmodified polyester resins, polystyrenes, poly-p-chlorostyrenes, polyvinyltoluenes, and other polymers of styrene and substituted styrenes; styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, and other styrenic copolymers; poly(methyl methacrylate), poly(butyl methacrylate), poly(vinyl chloride), poly(vinyl acetate), polyethylenes, polypropylenes, polyesters, epoxy resins, epoxy polyol resins, polyurethanes, polyamides, poly(vinyl butyral), poly(acrylic acid) resins, rosin, modified rosin, terpene resins, aliphatic or alicyclic hydrocarbon resins, aromatic petroleum resins, chlorinated paraffins, and paraffin waxes. Each of these resins can be used alone or in combination.

The master batch can be prepared by mixing and kneading a resin for master batch and the colorant under high shearing force. In this procedure, an organic solvent can be used for higher interaction between the colorant and the resin. In addition, a "flushing process" is preferably employed, in which an aqueous paste containing the colorant and water is mixed and kneaded with an organic solvent to thereby transfer the colorant to the resin component, and the water and organic solvent are then removed. According to this process, a wet cake of the colorant can be used as intact without drying. A high shearing dispersing apparatus such as a three-roll mill can be preferably used in mixing and kneading.

Releasing Agent

A known or conventional releasing agent can be used in the present invention. Such releasing agents include known waxes including polyolefin waxes such as polyethylene waxes and polypropylene waxes; long-chain hydrocarbon waxes such as paraffin waxes and Sasol waxes; and carbonyl-containing waxes. Among them, preferred waxes are carbonyl-containing waxes. Such carbonyl-containing waxes include, for example, polyalkanoic acid esters such as carnauba wax, montan wax, trimethylolpropane tribehenate, pentaerythritol tetrabehenate, pentaerythritol diacetate dibehenate, glycerol tribehenate, and 1,18-octadecanediol distearate; polyalkanol esters such as tristearyl trimellitate, and distearyl maleate; polyalkanoic acid amides such as ethylenediaminedibehenamide; polyalkylamides such as tristearylamide trimellitate; and dialkyl ketones such as distearyl ketone. Among these carbonyl-containing waxes, preferred are polyalkanoic acid esters. The wax generally has a melting point of 40° C. to 160° C., preferably 50° C. to 120° C., and more preferably 60° C. to 90° C. A wax with a melting point of lower than 40° C. may adversely affect the storage stability at high temperatures. In contrast, a wax with a melting point exceeding 160° C. may often invite cold offset upon image fixing at low temperatures. The wax has a melt viscosity of preferably from 5 to 1000 cps, and more preferably from 10 to 100 cps as measured at a temperature 20° C. higher than its melting point. A wax with a melt viscosity exceeding 1000 cps may not satisfactorily contribute to improve hot offset resistance and image-fixing properties at low temperatures. The content of the wax in the toner is generally from 0% to 40% by weight, and preferably from 3% to 30% by weight.

Charge Control Agent

The toner may further comprise a charge control agent according to necessity. Charge control agents include known charge control agents such as nigrosine dyes, triphenylmethane dyes, chromium-containing metal complex dyes, molybdic acid chelate pigments, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives. Examples of the charge control agents include commercially available products under the trade names of BONTRON 03 (Nigrosine dyes), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product) available from Orient Chemical Industries Co., Ltd.; TP-302 and TP-415 (molybdenum complex of quaternary ammonium salt) available from Hodogaya Chemical Co., Ltd.; COPY CHARGE PSY VP2038 (quaternary ammonium salt), COPY BLUE PR (triphenylmethane derivative), COPY CHARGE NEG VP2036 and COPY CHARGE NX VP434 (quaternary ammonium salt) available from Hoechst AG; LRA-901, and LR-147 (boron complex) available from Japan Carlit Co., Ltd.; as well as copper phthalocyanine pigments, perylene pigments, quinacridone pigments, azo pigments, and polymeric compounds having a functional group such as sulfonic group, carboxyl group, and quaternary ammonium salt.

The amount of the charge control agent is not specifically limited, can be set depending on the type of the binder resin, additives, if any, used according to necessity, and the method for preparing the toner including a dispersing process. Its amount is preferably from 0.1 to 10 parts by weight, and more preferably from 0.2 to 5 parts by weight relative to 100 parts by weight of the binder resin. If the amount exceeds 10 parts by weight, the toner may have an excessively high charge, the charge control agent may not sufficiently play its role, the developer may have increased electrostatic attraction to a development roller, may have decreased fluidity or may induce a decreased density of images. The charge control agent may be incorporated into the toner, for example, (1) by melting and kneading with the master batch and the resin to thereby dissolve or disperse the charge control agent therein, (2) by directly added to the organic solvent during the dispersion procedure, or (3) by immobilizing to the surface of prepared toner particles.

External Additive

Inorganic fine particles can be preferably used as the external additive to improve or enhance the flowability, developing properties, and charging ability of the toner particles. The inorganic fine particles have a primary particle diameter of preferably from 5 nm to 2 μm, and more preferably from 5 nm to 500 nm and have a specific surface area as determined by the BET method of preferably from 20 to 500 $m^2/g$. The amount of the inorganic fine particles is preferably from 0.01% by weight to 5% by weight, and more preferably from 0.01% by weight to 2.0% by weight of the toner. Examples of the inorganic fine particles are silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, and silicon nitride.

Other examples of the external additive are polymer particles such as polystyrene, copolymers of methacrylic esters or acrylic esters prepared by soap-free emulsion polymerization, suspension polymerization or dispersion polymerization; silicone resins, benzoguanamine resins, nylon resins, and other polycondensed or thermosetting resins.

A surface treatment is suitably performed on these external additives to improve hydrophobic property so that fluidity and charging ability are inhibited from being impaired even in a high humidity atmosphere. Suitable surface treatment agents are, for example, a silane coupling agent, a sililating agent, a silane coupling agent having a fluorinated alkyl group, an organic titanate coupling agent, an aluminium coupling agent, a silicone oil, and a modified silicone oil.

A cleaning agent (cleaning improver) may also be added in order to remove the developer remained on a photoconductor or on a primary transfer material after transfer. Suitable cleaning agents are, for example, metal salts of stearic acid and other fatty acids such as zinc stearate, and calcium stearate; and poly(methyl methacrylate) fine particles, polystyrene fine particles, and other fine polymer particles prepared by, for example, soap-free emulsion polymerization. Such fine polymer particles preferably have a relatively narrow particle distribution and a volume-average particle diameter of 0.01 to 1 μm.

Preparation of Binder Component

The toner binder can be prepared, for example, by the following method. A polyol (PO) and a polycarboxylic acid (PC) are heated at 150° C. to 280° C. in the presence of a known esterification catalyst such as tetrabutoxy titanate or dibutyltin oxide, and produced water is removed by distillation where necessary under a reduced pressure to thereby yield a hydroxyl-containing polyester. The hydroxyl-containing polyester is allowed to react with a polyisocyanate (PIC) at 40° C. to 140° C. and thereby yields an isocyanate-containing prepolymer (A). The prepolymer (A) is allowed to react with an amine (B) at 0° C. to 140° C. and thereby yields a polyester modified with urea bonds. In the reactions between the polyester and the polyisocyanate (PIC) and between the prepolymer (A) and the amine (B), solvents can be used according to necessity. Examples of solvents for use herein are solvents inert to the isocyanate (PIC) including aromatic solvents such as toluene and xylene; ketones such as acetone, methyl ethyl ketone, and methyl isobutyl ketone; esters such as ethyl acetate; amides such as dimethylformamide and dimethylacetamide; and ethers such as tetrahydrofuran. When the unmodified polyester (PE) not modified with urea bonds is used in combination, the unmodified polyester (PE) is prepared in the same manner as the hydroxyl-containing polyester, and the prepared unmodified polyester (PE) is added to and dissolved in a solution of the modified polyester (MPE) after the completion of the reaction.

Preparation of Toner

The toner of the present invention can be prepared, for example, by the following methods.

Toner Preparation in Aqueous Medium

Aqueous media may comprise water alone or in combination with an organic solvent that is miscible with water. Such miscible organic solvents include, but are not limited to, alcohols such as methanol, isopropyl alcohol, and ethylene glycol; dimethylformamide; tetrahydrofuran; Cellosorves such as methyl cellosolve; and lower ketones such as acetone and methyl ethyl ketone.

The toner particles can be prepared by allowing a dispersion containing the isocyanate-containing prepolymer (A) to react with the amine (B) in the aqueous medium or by using the prepared urea-modified polyester (MPE). They can be prepared, for example, by adding a composition of toner materials such as the urea-modified polyester (MPE) or the prepolymer (A) to the aqueous medium and dispersing the material by action of shear force. The other toner components (hereinafter referred to as "toner materials") such as the coloring agent, coloring agent master batch, releasing agent, charge control agent, and unmodified polyester resin may be mixed with the prepolymer (A) during a dispersing procedure in the aqueous medium for the formation of a dispersion. However, it is preferred that these toner materials are mixed with one another beforehand and the resulting mixture is added to the aqueous medium. The other toner materials such as the coloring agent, the mold release agent, and the charge control agent is not necessarily added during the formation of the particles in the aqueous medium and can be added to the formed particles. For example, particles containing no coloring agent are formed, and the coloring agent is then added to the formed particles according to a known dying procedure.

The dispersing procedure is not specifically limited and includes known procedures such as low-speed shearing, high-speed shearing, dispersing by friction, high-pressure jetting, and ultrasonic dispersion. To allow the dispersion to have an average particle diameter of 2 to 20 μm, the high-speed shearing procedure is preferred. When a high-speed shearing dispersing machine is used, the number of rotation is not specifically limited and is generally from 1000 to 30000 rpm and preferably from 5000 to 20000 rpm. The dispersion time is not specifically limited and is generally from 0.1 to 5 minutes in a batch system. The dispersing temperature is generally from 0° C. to 150° C. under a pressure (under a load) and preferably from 40° C. to 98° C. The dispersion is preferably performed at a relatively high temperature for lower viscosity of the dispersion containing the urea-modified polyester (MPE) or the prepolymer (A) and for easier dispersion.

The amount of the aqueous medium is generally from 50 to 2000 parts by weight, and preferably from 100 to 1000 parts by weight relative to 100 parts by weight of the toner composition containing the urea-modified polyester (MPE) or the prepolymer (A). If the amount is less than 50 parts by weight, the toner composition may not be dispersed sufficiently to thereby fail to yield toner particles having a set average particle diameter. If it exceeds 2000 parts by weight, it is not economical. Where necessary, a dispersing agent can be used. Such a dispersing agent is preferably used for sharper particle distribution and more stable dispersion.

The urea-modified polyester (MPE) can be prepared from the prepolymer (A) by allowing the prepolymer (A) to react with the amine (B) before dispersing the toner composition in the aqueous medium or by dispersing the prepolymer (A) in the aqueous medium and then adding the amine (B) to react at the particle interface. In this procedure, the urea-modified polyester is formed preferentially in the surface of the prepared toner particles, and the toner particles may have a concentration gradient.

To emulsify and disperse an oil phase containing the dispersed toner composition into a liquid containing water, a dispersing agent is used. Such dispersing agents include, but are not limited to, alkylbenzene sulfonates, α-olefin sulfonates, phosphoric esters, and other anionic surfactants; alkylamine salts, amino alcohol fatty acid derivatives, polyamine fatty acid derivatives, imidazoline, and other amine salts cationic surfactants, alkyltrimethylammonium salts, dialkyldimethylammonium salts, alkyldimethylbenzylammonium salts, pyridinium salts, alkylisoquinolinum salts, benzethonium chloride, other quaternary ammonium salts cationic surfactants, and other cationic surfactants; fatty acid amide derivatives, polyhydric alcohol derivatives, and other nonionic surfactants; alanine, dodecyl di(aminoethyl) glycine, di(octylaminoethyl) glycine, N-alkyl-N,N-dimethylammonium betaines, and other amphoteric surfactants.

The effects of the surfactants can be obtained in a small amount by using a surfactant having a fluoroalkyl group. Preferred examples of fluoroalkyl-containing anionic surfactants are fluoroalkylcarboxylic acids each containing 2 to 10 carbon atoms, and metallic salts thereof, disodium perfluorooctanesulfonyl glutamate, sodium 3-[omega-fluoroalkyl($C_6$–$C_{11}$)oxy]-1-alkyl ($C_3$–$C_4$) sulfonate, sodium 3-[omega-fluoroalkanoyl ($C_6$–$C_8$)-N-ethylamino]-1-propanesulfonate, fluoroalkyl ($C_{11}$–$C_{20}$) carboxylic acids and metallic salts thereof, perfluoroalkyl carboxylic acids ($C_7$–$C_{13}$) and metallic salts thereof, perfluoroalkyl($C_4$–$C_{12}$) sulfonic acids and metallic salts thereof, perfluorooctanesulfonic acid diethanolamide, N-propyl-N-(2-hydroxyethyl) perfluorooctanesulfonamide, perfluoroalkyl ($C_6$–$C_{10}$) sulfonamide propyl trimethyl ammonium salts, perfluoroalkyl ($C_6$–$C_{10}$)-N-ethylsulfonyl glycine salts, and monoperfluoroaklyl ($C_6$–$C_{16}$) ethyl phosphoric esters.

Such fluoroalkyl-containing anionic surfactants are commercially available under the trade names of, for example, SURFLON S-111, S-112 and S-113 (from Asahi Glass Co., Ltd.), FLUORAD FC-93, FC-95, FC-98 and FC-129 (from Sumitomo 3M Limited), UNIDYNE DS-101 and DS-102 (from Daikin Industries, Ltd.), MEGAFAC F-110, F-120, F-113, F-191, F-812 and F-833 (from Dainippon Ink & Chemicals, Incorporated), EFTOP EF-102, 103, 104, 105, 112, 123A, 123B, 306A, 501, 201 and 204 (from JEMCO Inc.), and FTERGENT F-100 and F-150 (from Neos Co., Ltd.).

Examples of fluoroalkyl-containing cationic surfactants for use in the present invention include aliphatic primary, secondary and tertiary amic acids each having a fluoroalkyl group; aliphatic quaternary ammonium salts such as perfluoroalkyl ($C_6$–$C_{10}$) sulfonamide propyltrimethylammonium salts; benzalkonium salts; benzethonium chloride; pyridinium salts; and imidazolinium salts. Such fluoroalkyl-containing cationic surfactants are commercially available, for example, under the trade names of SURFLON S-121 (from Asahi Glass Co., LTD.), FLUORAD FC-135 (from Sumitomo 3M Limited), UNIDYNE DS-202 (from Daikin Industries, LTD.), MEGAFAC F-150, and F-824 (from Dainippon Ink & Chemicals, Incorporated), EFTOP EF-132 (from JEMCO Inc.), and FTERGENT F-300 (from Neos Co., Ltd.).

In addition, an inorganic compound which is slightly soluble in water, tricalcium phosphate, calcium carbonate, titanium oxide, colloidal silica, and hydroxyapatite can be also used as the dispersing agent.

In the preparation of the toner of the present invention a polymeric protective colloid may be employed for stabilizing the primary particles in the dispersion. Examples of such polymer substance for protecting colloid include homopolymers or copolymers of acids such as acrylic acid, methacrylic acid, α-cyanoacrylic acid, α-cyanomethacrylic acid, itaconic acid, crotonic acid, fumaric acid, maleic acid, and maleic anhydride; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, and N-methylolmethacrylamide; vinyl alcohol and ethers thereof such as vinyl methyl ether, vinyl ethyl ether, and vinyl propyl ether; esters of vinyl alcohol and a carboxyl-group-containing compound, such as vinyl acetate, vinyl propionate, and vinyl butyrate; acrylamide, methacrylamide, diacetone acrylamide, and methylol compounds thereof; acid chlorides such as acryloyl chloride, and methacryloyl chloride; vinylpyridine, vinylpyrrolidone, vinylimidazole, ethyleneimine, and other vinyl monomers containing a nitrogen atom or having a nitrogen-containing heterocyclic ring. Examples of the polymer substance also include polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, and polyoxyethylene nonyl phenyl ester; and cellulose derivatives such as methyl cellulose, hydroxyethyl cellulose, and hydroxypropyl cellulose.

When calcium phosphate or another dispersion stabilizer that is soluble in acids or bases is used, the dispersion stabilizer is removed from the fine particles by dissolving the dispersion stabilizer by action of an acid such as hydrochloric acid and washing the fine particles. Alternatively, the dispersion stabilizer can be removed by, for example, decomposition by action of an enzyme.

When a dispersing agent is used, the dispersing agent may be allowed to remain on the surface of the toner particles but is preferably removed by washing after at least one of elongation reaction and crosslinking reaction from the viewpoint of toner charge properties.

In addition, a solvent that can dissolve the urea-modified polyester (MPE) and/or the prepolymer (A) can be used for lower viscosity of the toner composition. The solvent is preferably volatile and has a melting point of lower than 100° C. for easier removal. Such solvents include, but are not limited to, toluene, xylenes, benzene, carbon tetrachloride, methylene chloride, 1,2-dichloroethane, 1,1,2-trichloroethane, trichloroethylenes, chloroform, monochlorobenzene, dichloroethylidene, methyl acetate, ethyl acetate, methyl ethyl ketone, and methyl isobutyl ketone. Each of these solvents can be used alone or in combination. Among them, preferred solvents are toluene, xylene, and other aromatic hydrocarbon solvents, methylene chloride, 1,2-dichloroethane, chloroform, carbon tetrachloride, and other halogenated hydrocarbons. The amount of the solvent is generally from 0 to 300 parts by weight, preferably from 0 to 100 parts by weight, and more preferably from 25 to 70 parts by weight, relative to 100 parts by weight of the prepolymer (A). The solvent, if any, is removed by heating at atmospheric pressure or under reduced pressure after the elongation and/or crosslinking reaction.

The reaction time for elongation and/or crosslinking between the reactive modified polyester (RMPE) and the amine (B) as a crosslinking agent and/or elongation agent is appropriately set depending on the reactivity based on the combination of the isocyanate structure of the prepolymer (A) and the amine (B) and is generally from 10 minutes to 40 hours and preferably from 2 to 24 hours. The reaction temperature is generally from 0° C. to 150° C. and preferably from 40° C. to 98° C. Where necessary, a known catalyst such as dibutyltin laurate and dioctyltin laurate can be used.

Preparation of Non-Spherical Particles

To prepare non-spherical particles, a highly viscous aqueous solution (aqueous phase) containing a thickening agent and/or surfactant is mixed with an emulsified dispersion (oil phase), the mixture is subjected to a device for imparting shear force, such as a T. K. Homo Mixer (trade name, available from Tokushu Kika Kogyo Co., Ltd.) or Ebara Milder (trade name, available from Ebara Corporation) to thereby deform the emulsified particles due to the difference in viscosity between the oil phase and the aqueous phase. A target shape of particles can be obtained by controlling the difference in viscosity between the oil phase and the aqueous phase. The difference in viscosity can be controlled by adjusting the concentration of the hydrophilic organic solvent and the temperature of the oil phase, the thickening agent and surfactant and the temperature of the aqueous phase. The hydrophilic organic solvent can be any of those conventionally known, of which ethyl acetate is preferred. The shape of the particles can also be controlled by adjusting the shear force of the device used, for example, by controlling the shape of the device, the treatment time, the number of treatment cycles, and/or the treatment temperature.

The organic solvent can be removed from the prepared emulsion, for example, by gradually elevating the temperate of the entire system and completely removing the organic solvent in the primary particles by evaporation. Alternatively, it can be removed by spraying the emulsion into a dry atmosphere, thereby completely removing the non-water-soluble organic solvent in the primary particles to thereby form fine toner particles while removing the water-based dispersing agent by evaporation. The dry atmosphere to which the emulsion is sprayed includes, for example, heated gases such as air, nitrogen gas, carbon dioxide gas, and combustion gas. The gas is preferably heated to a temperature higher than the boiling point of a solvent having the highest boiling point. A desired product can be obtained by short-time drying using a dryer such as spray dryer, belt dryer or rotary kiln.

When the particle distribution of the primary particles is wide and the adjustment of the particle distribution is not carried out in the washing and drying processes, the particles in the emulsion may be classified.

The particles can be classified by removing fine particle fractions using a cyclone, decanter or centrifugal separator in a liquid. Although the classification can be carried out on dried particles after drying, it is more preferred that the classification is carried out in a solution, from the viewpoint of efficiency of the process. The obtained irregular toner particles and coarse particles, as a result of the classification, are sent back to the kneading step so as to recycle. In this case, the fine particles or coarse particles may be in a wet condition.

The dispersing agent is preferably removed from the obtained dispersion, and more preferably removed at the same time of the classification.

The dried toner powder particles may be mixed with finely-divided particles of various agents such as a releasing agent, a charge control agent, a flowability-imparting agent, and a coloring agent. By the application of mechanical impact to the mixture of particles, the finely-divided particles of various agents can be fixedly deposited on the surface of the toner particles or uniformly blended with the toner particles on the surface thereof. Thus, the particles of various agents attached to the surface of the toner particles can be prevented from falling off.

Specific methods for applying an impact force are, for example, a method in which the impact force is applied to the mixed particles by using a rotated impeller blade in high speed, a method in which the mixed particles are placed in high-speed flow so as to subject the mixed particles or complex particles to be in a collision course with a suitable collision board. Examples of apparatus therefor include angmill (available from Hosokawa Micron Corporation), a modified I-type mill (available from Nippon Pneumatic MFG., Co., Ltd.) which is reduced pulverizing air pressure, a hybridization system (available from Nara Machine Corporation), Kryptron System (available from Kawasaki Heavy Industries, Ltd.), and an automatic mortar.

Two-Component Carrier

The toner of the present invention can be used in combination with a magnetic carrier in a two-component developer. The amount of the toner in the developer is preferably from 1 to 10 parts by weight relative to 100 parts by weight of the carrier. Such magnetic carriers include, for example, conventional magnetic particles with a particle diameter of about 20 to about 200 μm, made of iron, ferrite, magnetite, and magnetic resins. Coating materials for use herein include, but are not limited to, amine resins such as urea-formaldehyde resins, melamine resins, benzoguanamine resins, urea resins, polyamide resins, and epoxy resins; polyvinyl and polyvinylidene resins such as acrylic resins, poly (methyl methacrylate) resins, polyacrylonitrile resins, poly (vinyl acetate) resins, poly(vinyl alcohol) resins, poly(vinyl butyral) resins, polystyrene resins, styrene-acrylic copolymer resins, and other styrenic resins; poly(vinyl chloride) and other halogenated olefin resins; poly(ethylene terephthalate) resins, poly(butylene terephthalate) resins, and other polyester resins; polycarbonate resins; polyethylene resins; poly(vinyl fluoride) resins, poly(vinylidene fluoride) resins, polytrifluoroethylene resins, polyhexafluoropropylene resins, copolymers of vinylidene fluoride and acrylic monomer, vinylidene fluoride-vinyl fluoride copolymers, terpolymers of tetrafluoroethylene, vinylidene fluoride, and a non-fluorinated monomer, and other fluoroterpolymers; and silicone resins. The resin for use in the coating material may further comprise a conductive powder according to necessity. Such conductive powders include, for example, powders of metals, carbon black, titanium oxide, tin oxide, and zinc oxide. These conductive powders preferably have an average particle diameter of 1 μm or less. If the average particle diameter exceeds 1 μm, the electric resistance of the developer may not sufficiently be controlled.

The toner of the present invention can also be used as a one-component magnetic or non-magnetic toner without using a carrier.

The process cartridge of the present invention uses the toner of the present invention, integrally has a photoconductor and at least one means selected from charging means, developing means, and cleaning means and is detachable from and attachable to a main body of an image forming apparatus.

Figure 4:
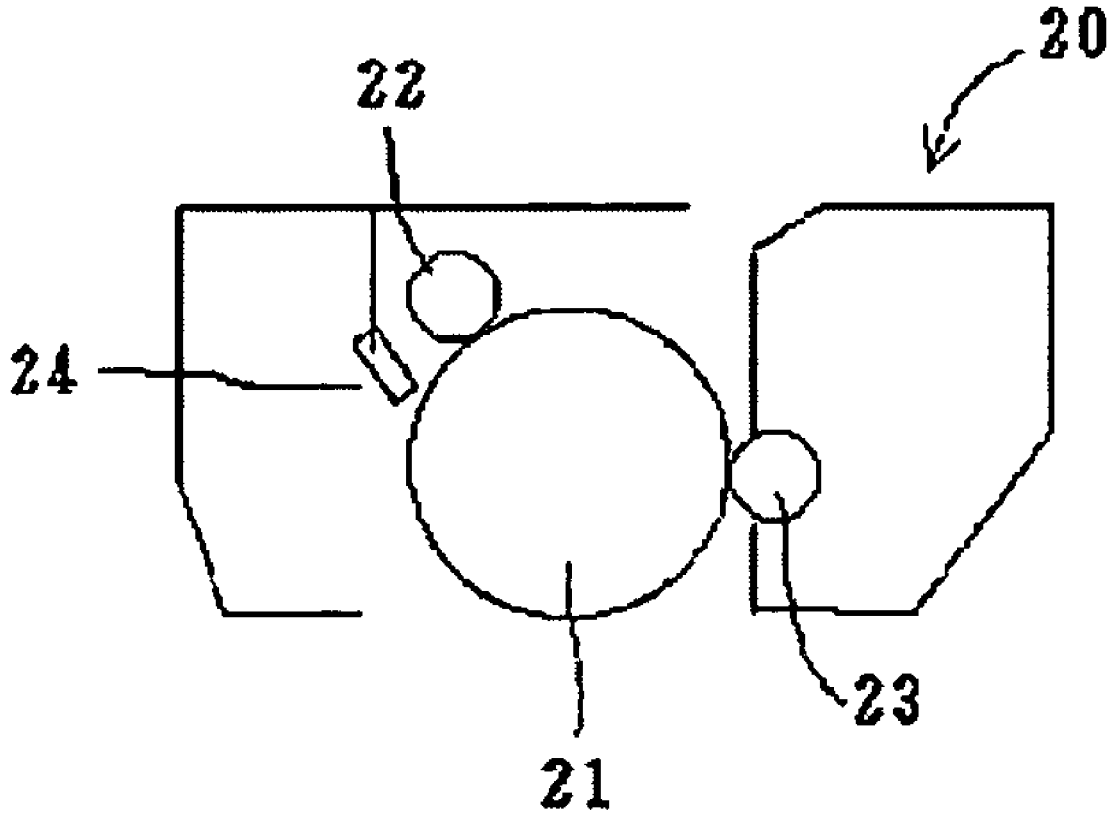
FIG. 4 is a schematic view of an example of an image forming apparatus having a process cartridge of the present invention.

FIG. 4 is a schematic diagram of an image forming apparatus having the process cartridge of the present invention.

The process cartridge 20 of FIG. 4 includes a photoconductor 21, a charger 22, a developer (developing device) 23, and a cleaner 24.

According to the present invention, the photoconductor 21 and at least one of the charger 22, developer 23, and cleaner 24 are integrally incorporated to form a process cartridge which is configured as being detachable and attachable to a main body of an image forming apparatus such as a copier or printer.

In the image forming apparatus which equips the process cartridge of the present invention, the photoconductor is rotated at a predetermined peripheral speed. During the cycle of a rotation of the photoconductor, the charger (charging means) uniformly charges the photoconductor at predetermined positive or negative potential, thereafter a light irradiator such as slit exposure or laser beam scanning exposure, irradiates light imagewise to the charged photoconductor. In this way, latent electrostatic images are sequentially formed on the circumference surface of the photoconductor. As follow, the image developer develops the formed latent electrostatic image with the toner so as to form a toner image, and then the transfer sequentially transfer the toner image onto a transfer medium which is fed from a paper feeder to between the photoconductor and the transfer at the same timing to the rotation of the photoconductor. The transfer medium bearing the transferred toner image is separated from the photoconductor, and is introduced to the fixer. The fixer fixes the transferred image onto the transfer medium so as to form a reproduction (copy) and then the copy is sent out from the apparatus, i.e., printed out. After transferring the toner image, cleaner removes the remained toner onto the surface of the photoconductor so as to clean the surface. Thereafter, the charge of the photoconductor is eliminated for another image formation.

The photoconductor for use in the image forming apparatus is preferably an amorphous silicon photoconductor.

Amorphous Silicon Photoconductor

In the present invention, an amorphous silicon photoconductor is used as a photoconductor for electrophotography. The amorphous silicon photoconductor (hereinafter referred to as a-Si photoconductor) has a conductive substrate and a photoconductive layer formed of a-Si. The photoconductive layer is formed on the substrate, while heating it to a temperature of from 50 ° C. to 400 ° C., by a film forming method such as vacuum deposition, sputtering, ion-plating, thermal CVD, optical CVD, plasma CVD, or the like. Of these, preferable method is plasma CVD in which raw material gas is decomposed by glow discharge of direct current, high frequency or microwave, and then a-Si is deposited on the substrate so as to form an a-Si film.

Layer Structure

Figure 5A:
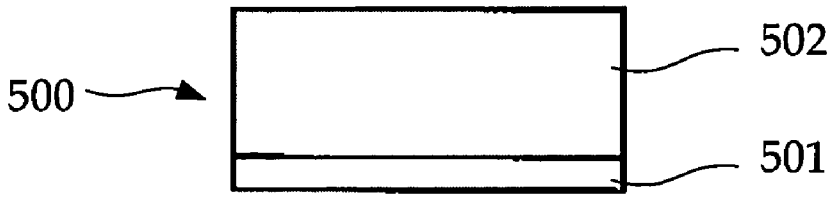
FIGS. 5A, 5B, 5C, and 5D are each a schematic diagram of an example of the layer configuration of a photoconductor for use in an example of the present invention.
Figure 5B:
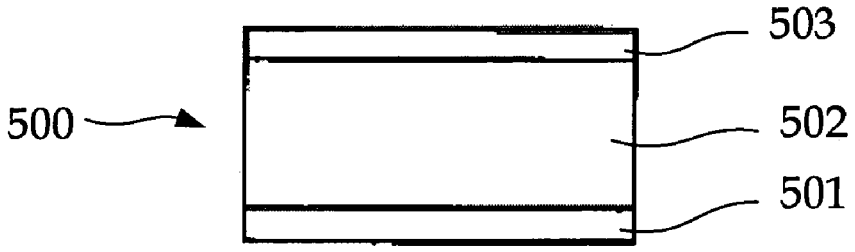
Figure 5C:
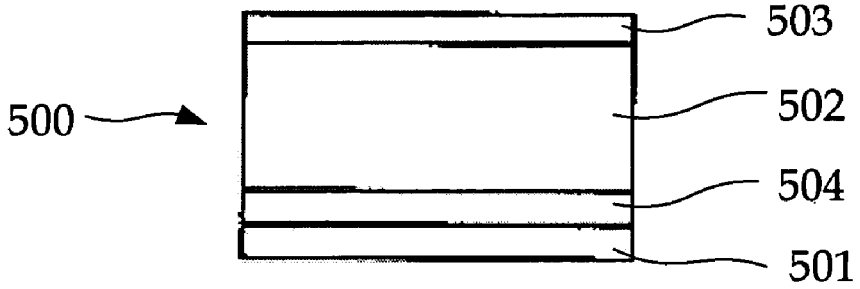
Figure 5D:
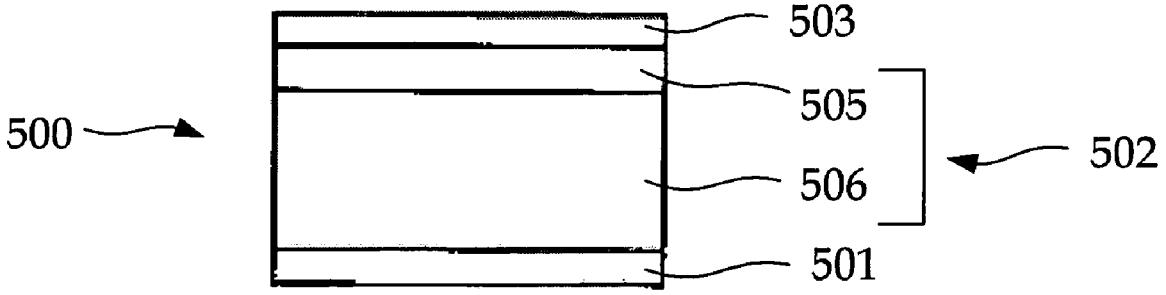

Examples of the layer structure of the amorphous silicon photoconductor are as follows. FIGS. 5A, 5B, 5C and 5D are schematic diagrams which explain the layer structure of the amorphous silicon photoconductor. With reference to FIG. 5A, a photoconductor for electrophotography 500 has a substrate 501 and a photoconductive layer 502 on the substrate 501. The photoconductive layer 502 is formed of a-Si:H, X, and exhibits photoconductivity. With reference to FIG. 5B, a photoconductor for electrophotography 500 has a substrate 501, on which a photoconductive layer 502 formed of a-Si:H, X and an amorphous silicon surface layer 503 are arranged. With reference to FIG. 5C, a photoconductor for electrophotography 500 has a substrate 501, and on the substrate 501, a photoconductive layer 502 formed of a-Si:H, X, an amorphous silicon surface layer 503 and an amorphous silicon charge injection inhibiting layer 504. With reference to FIG. 5D, a photoconductor for electrophotography 500 has a substrate 501 and a photoconductive layer 502 on the substrate 501. The photoconductive layer 502 comprises a charge generation layer formed of a-Si:H, X 505 and a charge transport layer 506. The photoconductor for electrophotography 500 further has an amorphous silicon surface layer 503 on the photoconductive layer 502.

Substrate

The substrate of the photoconductor may be electrically conductive or insulative. Examples of the conductive substrate include metals such as Al, Cr, Mo, Au, In, Nb, Te, V, Ti, Pt, Pd, and Fe, and alloys thereof such as stainless steel. An insulative substrate in which at least a surface facing to a photoconductive layer is treated to yield conductivity can also be used as the substrate. Examples of such insulative substrates are a film or sheet of a synthetic resin such as a polyester, polyethylene, polycarbonate, cellulose acetate, polypropylene, polyvinyl chloride, polystyrene or polyamide, glass, or ceramic.

The shape of the substrate may be cylindrical, plate, or endless belt, which has a smooth or irregular surface. The thickness thereof can be adjusted so as to form a predetermined photoconductor. In the case that flexibility is required to the photoconductor, the substrate can be as thin as possible within ranges efficiently functioning as a substrate. The thickness of the substrate is generally 10 μm or more from the viewpoints of, for example, manufacture, handling, and mechanical strength.

Charge Injection Inhibiting Layer

In the photoconductor used in the present invention, it is effective to dispose a charge injection inhibiting layer between the conductive substrate and the photoconductive layer (FIG. 5C). The charge injection inhibiting layer inhibits a charge injection from the conductive substrate. The charge injection inhibiting layer has a polarity dependency. Namely, when charges of a specific polarity are applied to a free surface of the photoconductor, the charge injection inhibiting layer functions so as to inhibit a current injection from the conductive substrate to the photoconductive layer, and when charges of the opposite polarity are applied, the charge injection inhibiting layer does not function. In order to attain such function, the charge injection inhibiting layer contains relatively larger amounts of atoms which control conductivity, compared with the photoconductive layer.

The thickness of the charge injection inhibiting layer is preferably about 0.1 μm to about 5 μm, more preferably 0.3 μm to 4 μm, and furthermore preferable 0.5 μm to 3 μm for desired electrophotographic properties and better economical efficiency.

Photoconductive Layer

The photoconductive layer may be disposed above the substrate 501 according to necessity. The thickness of the photoconductive layer is not particularly limited, as long as desired electrophotographic properties and high cost efficiency are obtained. The thickness is preferably about 1 μm to about 100 μm, more preferably 20 μm to 50 μm, and furthermore preferably 23 μm to 45 μm.

Charge Transport Layer

When the photoconductive layer is divided by its functions into plural layers, the charge transport layer mainly functions to transport currents. The charge transport layer comprises at least silicon atoms, carbon atoms, and fluorine atoms as its essential components. If needed, the charge transport layer may further comprise hydrogen atoms and oxygen atoms so that the charge transport layer is formed of a-SiC(H,F,O). Such charge transport layer exhibits desirable photoconductivity, especially charge holding property, charge generating property, and charge transporting property. It is particularly preferable that the charge transport layer contains an oxygen atom.

The thickness of the charge transport layer is suitably adjusted so as to yield desirable electrophotographic property and cost efficiency. The thickness thereof is preferably about 5 μm to about 50 μm, more preferably 10 μm to 40 μm, and the most preferably 20 μm to 30 μm.

Charge Generation Layer

When the photoconductive layers is divided by its functions into plural layers, the charge generation layer mainly functions to generate charges. The charge generation layer contains at least silicon atoms as an essential component and does not substantially contain a carbon atom. If needed, the charge generation layer may further comprise hydrogen atoms so that the charge generation layer is formed of a-Si:H. Such charge generation layer exhibits desirable photoconductivity, especially charge generating property and charge transporting property.

The thickness of the charge generation layer is suitably adjusted so as to yield desirable electrophotographic property and cost efficiency. The thickness thereof is preferably about 0.5 μm to about 15 μm, more preferably 1 μm to 10 μm, and the most preferably 1 μm to 5 μm.

Surface Layer

The amorphous silicon photoconductor for use in the present invention may further contain a surface layer disposed on the photoconductive layer formed as mentioned above on the substrate. The surface layer is preferably an amorphous silicon layer. The surface layer has a free surface so that desirable properties such as moisture resistance, usability in continuous repeated use, electric strength, stability in operating environment, and durability.

The thickness of the surface layer is generally about 0.01 μm to about 3 μm, preferably 0.05 μm to 2 μm, and more preferably 0.1 μm to 1 μm. If the thickness is less than about 0.01 μm, the surface layer is worn out during usage of the photoconductor. If it exceeds about 3 μm, electrophotographic properties are impaired such as an increase of residual charge.

The image forming apparatus of the present invention is preferably so configured as to apply an alternating field when a latent electrostatic image on the photoconductor is developed.

Figure 6:
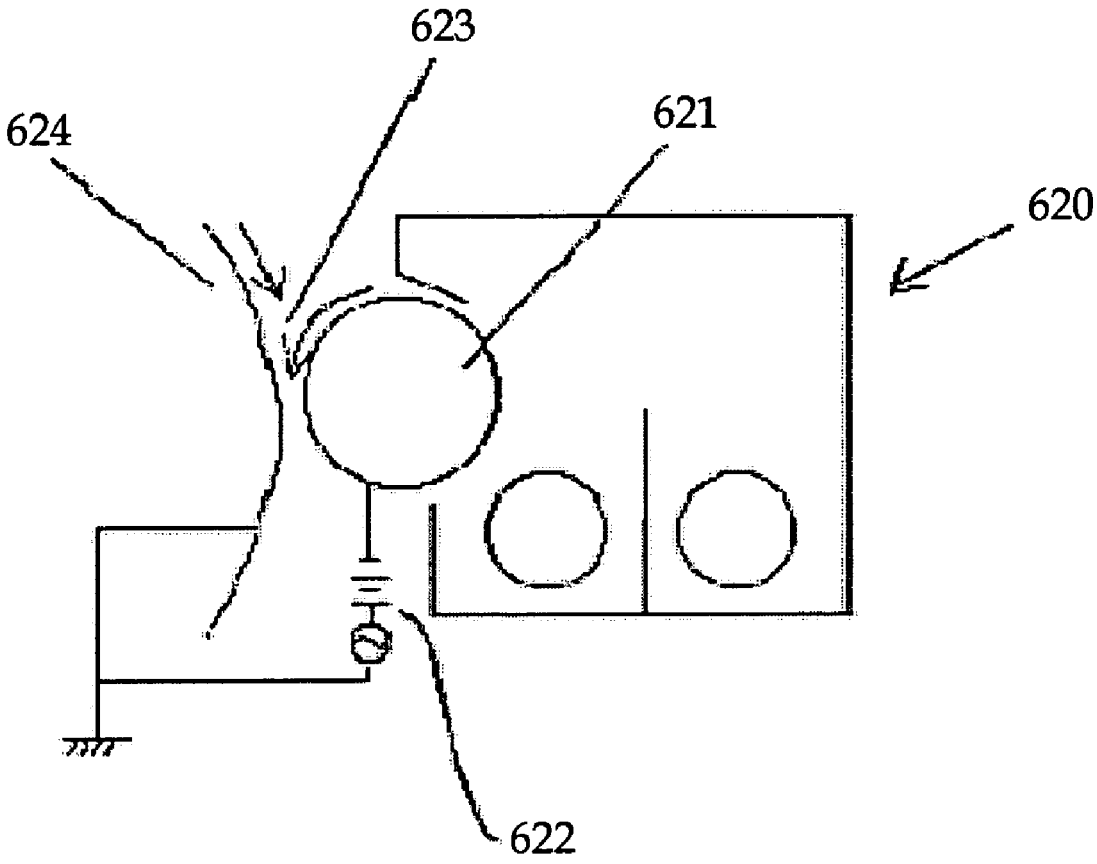
FIG. 6 is a schematic diagram of a developing device for use in an example of the present invention.

In a developing device 620 according to the present embodiment shown in FIG. 6, a power supply 622 applies a vibrating bias voltage as developing bias, in which a direct current voltage and an alternating voltage are superimposed, to a developing sleeve 621 during developing. The potential of background part and the potential of image part are positioned between the maximum and the minimum of the vibration bias potential. This forms an alternating field, whose direction alternately changes, at developing region 623. A toner and a carrier in the developer are intensively vibrated in this alternating field, so that the toner overshoots the electrostatic force of constraint from the developing sleeve 621 and the carrier, and leaps to the photoconductor drum 624. The toner is then attached to the photoconductor 624 in accordance with a latent electrostatic image thereon.

The difference between the maximum and the minimum of the vibration bias voltage (peak to peak voltage) is preferably 0.5 kV to 5 kV, and the frequency is preferably 1 kHz to 10 kHz. The waveform of the vibration bias voltage may be a rectangular wave, a sine wave, or a triangular wave. The direct current voltage of the vibration bias voltage is in a range between the potential at the background and the potential at the image as mentioned above, and is preferably set closer to the potential at the background from viewpoints of inhibiting a toner deposition on the background.

When the vibration bias voltage is a rectangular wave, it is preferred that a duty ratio is 50% or less. Duty ratio is a ratio of time when the toner leaps to the photoconductor during a cycle of the vibration bias. In this way, the difference between the peak value when the toner leaps to the photoconductor and the time average value of bias can become very large. Consequently, the movement of the toner becomes further activated, and the toner is accurately attached to the potential distribution of the latent electrostatic image. Accordingly, rough depositition is reduced and image resolution can be improved. Moreover, the difference between the peak value when the oppositely charged carrier leaps to the photoconductor and the time average value of bias can be decreased. Consequently, the movement of the carrier can be restrained and the possibility of the carrier deposition on the background is largely reduced.

The charger (electrostatic charger) for use in the image forming apparatus of the present invention is preferably a contact charger. Such a charger contains an electrostatic charging member, and the electrostatic charging member is brought in contact with the photoconductor as a latent electrostatic image bearing member and applies voltage so as to charge the photoconductor.

Roller Charger

Figure 7A:
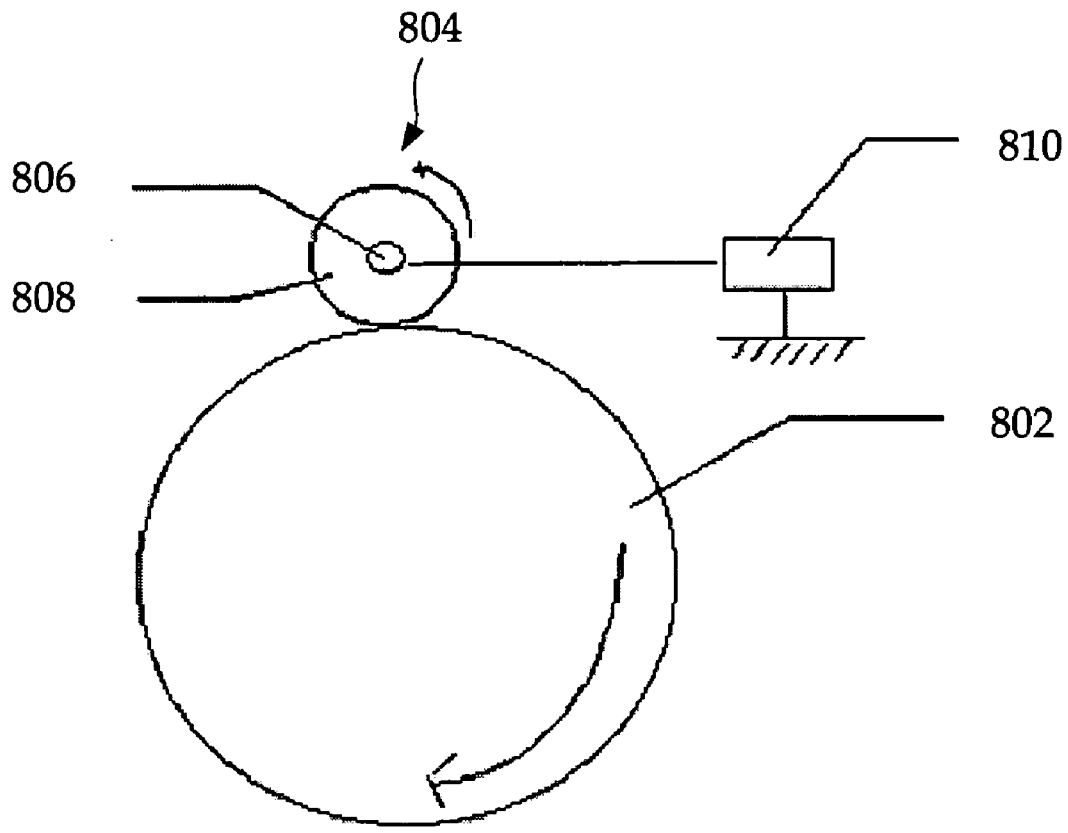
FIGS. 7A and 7B are schematic diagrams of a roller contact charger and a brush contact charger, respectively.

FIG. 7A is a schematic diagram of an example of the image-forming apparatus that is equipped with a contact charger. The photoconductor 802 to be charged as an image bearing member is rotated at a predetermined speed (process speed) in the direction shown with the arrow in the figure. The charging roller 804, which is brought into contact with the photoconductor 802, contains a core rod 806 and a conductive rubber layer 808 formed on the core rod 806 in a shape of a concentric circle. The both terminals of the core rod 806 are supported with bearings (not shown) so that the charging roller 804 enables to rotate freely, and the charging roller 804 is pressed to the photoconductor 802 at a predetermined pressure by a pressurizing member (not shown). The charging roller 804 in this figure therefore rotates along with the rotation of the photoconductor. The charging roller 804 is generally formed with a diameter of 16 mm in which a core rod having a diameter of 9 mm is coated with a rubber layer having a moderate resistance of approximately 100,000 Ω·cm.

The power supply 810 shown in the figure is electrically connected with the core rod, and a predetermined bias is applied to the core rod by the power supply. Thus, the surface of the photoconductor is uniformly charged at a predetermined polarity and potential.

As a charger for use in the present invention, the shape thereof is not specifically limited and can for example be, apart from a roller, a magnetic brush or a fur brush. It can be suitably selected according to a specification or configuration of an image-forming apparatus. When a magnetic brush is used as a charger, the magnetic brush contains an electrostatic charger formed of various ferrite particles such as Zn—Cu ferrite, a non-magnetic conductive sleeve to support the electrostatic charger, and a magnetic roller contained in the non-magnetic conductive sleeve. When a fur brush is used as a charger, a material of the fur brush is, for example, a fur that is made conductive by treatment with, for example, carbon, copper sulfide, a metal or a metal oxide, and the fur is coiled or mounted to a metal or another core rod which is treated conductive.

Fur Brush Charger

Figure 7B:
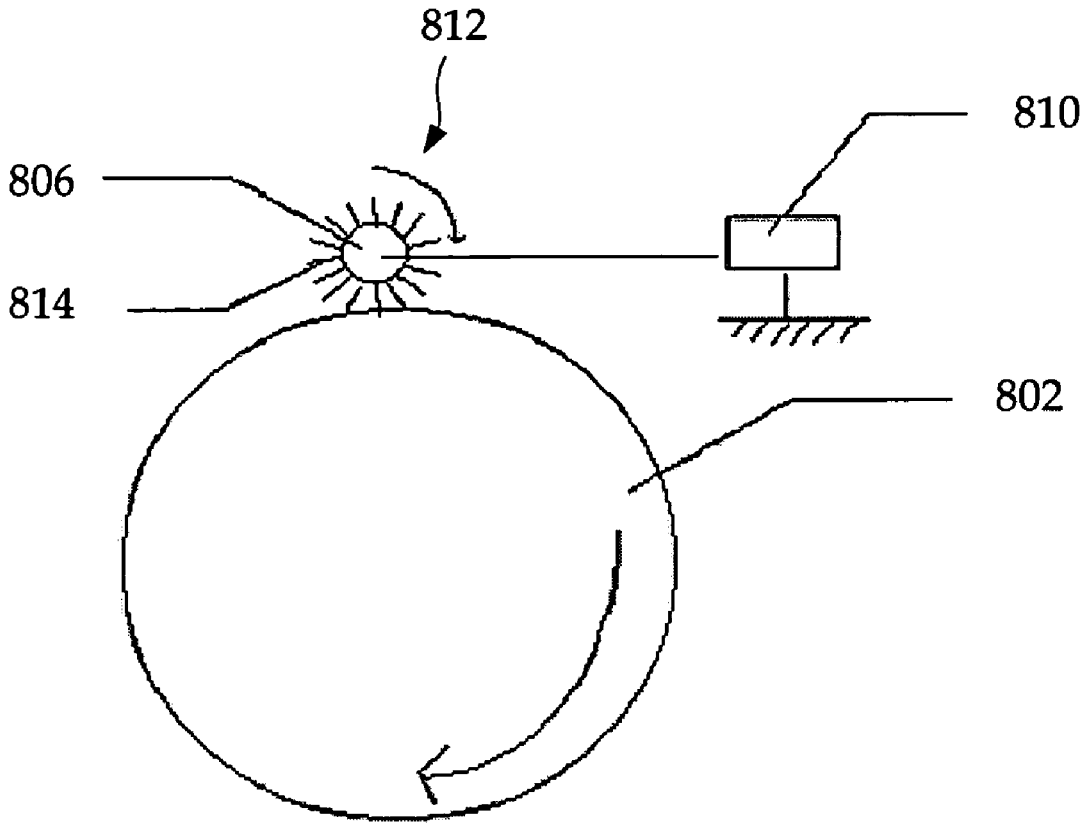

FIG. 7B is a schematic diagram of another example of the image-forming apparatus that is equipped with a contact charger. The photoconductor 802 as an object to be charged and image bearing member, is rotated at a predetermined speed (process speed) in the direction shown with the arrow in the figure. The brush roller 812 having a fur brush is brought in contact with the photoconductor 802, with a predetermined nip width and a predetermined pressure with respect to elasticity of the brush part 814.

The fur brush roller 812 as the contact charger used in the present invention has an outside diameter of 14 mm and a longitudinal length of 250 mm. In this fur brush, a tape with a pile of conductive rayon fiber REC-B (trade name, available from Unitika Ltd.), as a brush part 814, is spirally coiled around a metal core rod 806 having a diameter of 6 mm, which is also functioned as an electrode. The brush of the brush part 814 is of 300 denier/50 filament, and a density of 155 fibers per 1 square millimeter. This brush roller is once inserted into a pipe having an internal diameter of 12 mm while rotating in one direction, and is set so as to share the same axis with the pipe. Thereafter, the brush roller in the pipe is left in an atmosphere of high humidity and high temperature so as to twist the fibers of the fur.

The resistance of the fur brush roller is $1\times10^5$ Ω at an applied voltage of 100 V. This resistance is calculated from the current obtained when the fur brush roller is contacted with a metal drum having a diameter of 30 mm with a nip width of 3 mm, and a voltage of 100 V is applied thereon.

The resistance of the fur brush roller should be $10^4$ Ω or more in order to prevent image imperfection caused by an insufficient charge at the charging nip part when the photoconductor to be charged happens to have low electric strength defects such as pin holes thereon and an excessive leak current therefore runs into the defects. Moreover, it should be $10^7$ Ω or less in order to sufficiently charge the surface of the photoconductor.

Examples of the material of the fur include, in addition to REC-B (trade name, available from Unitika Ltd.), REC-C, REC-M1, REC-M10 (trade names, available from Unitika Ltd.), SA-7 (trade name, available from Toray Industries, Inc.), Thunderon (trade name, available from Nihon Sanmo Dyeing Co., Ltd.), Beltron (trade name, available from Kanebo Gohsen, Ltd.), Kuracarbo in which carbon is dispersed in rayon (trade name, available from Kuraray Co., Ltd.), and Roval (trade name, available from Mitsubishi Rayon Co., Ltd.). The brush is of preferably 3 to 10 denier per fiber, 10 to 100 filaments per bundle, and 80 to 600 fibers per square millimeter. The length of the fur is preferably 1 to 10 mm.

The fur brush roller is rotated in the opposite (counter) direction to the rotation direction of the photoconductor at a predetermined peripheral velocity, and comes into contact with the photoconductor with a velocity deference. The power supply applies a predetermined charging voltage to the fur brush roller so that the surface of the photoconductor is uniformly charged at a predetermined polarity and potential. In contact charge of the photoconductor by the fur brush roller of the present embodiment, charges are mainly directly injected and the surface of the photoconductor is charged at the substantially equal voltage to the applying charging voltage to the fur brush roller.

The electrostatic charger for use in the present invention is not specifically limited in its shape and can be, for example, a charging roller or magnetic fur blush, as well as a fur blush roller. The shape can be selected according to the specification and configuration of the image forming apparatus. When a charging roller is used, it generally comprises a core rod and a rubber layer of moderate resistance of about 100,000 Ω·cm coated on the core rod. When a magnetic fur blush is used, it generally comprises, for example, particles of ferrite such as Zn—Cu ferrite as an electrostatic charging member, a non magnetic conductive sleeve supporting the ferrite particles, and a magnet roll included in the conductive sleeve.

Magnetic Brush Charger

FIG. 7B is a schematic diagram of one example of the image-forming apparatus that is equipped with a contact charger. This figure can be used to illustrate an embodiment using a magnetic brush charger as well. The photoconductor 802 as an object to be charged and image bearing member is rotated at a predetermined speed (process speed) in the direction shown with the arrow in the figure. The brush roller 812 having a magnetic brush is brought in contact with the photoconductor 802, with a predetermined nip width and a predetermined pressure with respect to elasticity of the brush part 814.

The magnetic brush 812 as a contact charger of the present embodiment is formed of magnetic particles. In the magnetic particles, Zn—Cu ferrite particles having an average particle diameter of 25 μm and Zn—Cu ferrite particles having an average particle diameter of 10 μm are mixed in a ratio of 1/0.05 so as to form ferrite particles having peaks at each average particle diameter, and a total average particle diameter of 25 μm. The ferrite particles are coated with a resin layer having a moderate resistance so as to form the magnetic particles. The contact charger of this embodiment formed from the above-mentioned coated magnetic particles, a non-magnetic conductive sleeve which supports the coated magnetic particles, and a magnet roller which is included in the non-magnetic conductive sleeve. The coated magnetic particles are disposed on the sleeve with a thickness of 1 mm so as to form a charging nip 5 mm wide with the photoconductor. The gap between the non-magnetic conductive sleeve and the photoconductor is adjusted to approximately 500 μm. The magnetic roller is rotated so as to subject the non-magnetic conductive sleeve to rotate so that its surface is at twice in speed relative to the peripheral speed of the surface of the photoconductor, and in the opposite direction with the photoconductor. Therefore, the magnetic brush is uniformly in contact with the photoconductor.

As a charger for use in the present invention, the shape thereof is not specifically limited and can for example be, apart from a magnetic brush, a charging roller or a fur brush. It can be suitably selected according to a specification or configuration of an image forming apparatus. When a charging roller is used, it generally comprises a core rod and a rubber layer of moderate resistance of about 100,000 Ω·cm coated on the core rod. When a fur brush is used as a charger, a material of the fur brush is, for example, a fur that becomes conductive by treatment with, for example, carbon, copper sulfide, a metal or a metal oxide, and the fur is coiled or mounted to a metal or another core rod which becomes conductive by treatment.

The present invention will be illustrated in further detail with reference to several examples below, which ate never intended to limit the scope of the present invention. All of the words "part" and "parts" hereinafter mean "part by weight" or "parts by weight" unless otherwise indicated.

Toners used in the examples are shown in Table 1.

EXAMPLE 1

Preparation Example 1

Preparation of Organic Fine Particle Emulsion

In a reactor equipped with a stirring rod and a thermometer were placed 754 parts of water, 13 parts of a sodium salt of sulfuric acid ester of ethylene oxide adduct of methacrylic acid ELEMINOL RS-30 (trade name, available from Sanyo Chemical Industries, Ltd.,), 83 parts of styrene, 83 parts of methacrylic acid, 110 parts of butyl acrylate and 1 part of ammonium persulfate, and the mixture was stirred at 400 rpm for 15 minutes to yield a white emulsion. The emulsion was heated to an inner temperature of 75° C., followed by reaction for 5 hours. The reaction mixture was further treated with 30 parts of a 1% aqueous solution of ammonium persulfate, was aged at 75° C. for 5 hours and thereby yielded an aqueous dispersion [Polymer Fine Particle Dispersion 1] of a vinyl resin (a copolymer of styrene-methacrylic acid-butyl acrylate-sodium salt of sulfuric acid ester of ethylene oxide adduct of methacrylic acid). Fine Particle Dispersion 1 had a volume-average particle diameter of 0.10 μm as determined with a laser diffraction-scattering size distribution analyzer LA-920 (trade name, available from Horiba, Ltd.). Part of Fine Particle Dispersion 1 was dried to isolate a resin component. The resin component had a Tg of 57° C.

Preparation Example 2

Preparation of Aqueous Phase

Aqueous Phase 1 was prepared as an opaque liquid by blending and stirring 990 parts of water, 80 parts of Fine Particle Dispersion 1, 40 parts of a 48.5% aqueous solution of sodium dodecyl diphenyl ether disulfonate ELEMINOL MON-7 (trade name, available from Sanyo Chemical Industries, Ltd.), and 90 parts of ethyl acetate.

Preparation Example 3

Preparation of Unmodified Polyester

In a reactor equipped with a condenser, a stirrer and a nitrogen gas feed tube were placed 570 parts of an ethylene oxide (2 mole) adduct of bisphenol A, 217 parts of terephthalic acid and 2 parts of dibutyltin oxide. The mixture was reacted at 230° C. at normal atmospheric pressure for 8 hours and was further reacted at a reduced pressure of 10 to 15 mmHg for 5 hours. After cooling to 110° C., the reaction mixture was further treated with 18 parts of trimellitic anhydride for 2 hours and thereby yielded Unmodified Polyester 1 (PE 1).

Preparation Example 4

Preparation of Prepolymer

In a reactor equipped with a condenser, a stirrer and a nitrogen gas feed tube were placed 343 parts of ethylene oxide (2 mole) adduct of bisphenol A, 100 parts of isophthalic acid, 66 parts of terephthalic acid and 2 parts of dibutyltin oxide. The mixture was reacted at 230° C. at normal atmospheric pressure for 8 hours and was further reacted at a reduced pressure of 10 to 15 mmHg for 5 hours. After cooling to 110° C., the reaction mixture was further treated with 32 parts of trimellitic anhydride for 2 hours. After cooling to 80° C., the reaction mixture was treated with 17 parts of isophorone diisocyanate for 2 hours and thereby yielded Isocyanate-containing Prepolymer 1.

Preparation Example 5

Preparation of Ketimine Compound

In a reactor equipped with a stirring rod and a thermometer were placed 170 parts of isophoronediamine and 70 parts of methyl ethyl ketone, followed by reaction at 50° C. for 5 hours to yield Ketimine Compound 1.

Preparation Example 6

Preparation of Toner

In a beaker were stirred and dissolved 14.3 parts of Prepolymer 1, 55 parts of Unmodified Polyester 1 (PE 1) and 78.6 parts of ethyl acetate. The solution was stirred with 10 parts of rice wax (melting point: 83° C.) as a releasing agent and 7 parts of carbon black #44 (available from Mitsubishi Chemical Corporation) using a T. K. Homo Mixer (trade name, available from Tokushu Kika Kogyo Co., Ltd.) at 12000 rpm at 60° C. for 5 minutes and was dispersed using a bead mill at 20° C. for 30 minutes to yield Toner Material Solution 1.

A total of 306 parts of Aqueous Phase 1 was placed in a beaker. A mixture of Toner Material Solution 1 as prepared in the above-described manner and 2.7 parts of Ketimine Compound 1 was added to Aqueous Phase 1 with stirring at 12000 rpm using a T. K. Homo Mixer (trade name, available from Tokushu Kika Kogyo Co., Ltd.) for urea reaction. In this procedure, the particle diameter and particle distribution were observed with an optical microscope. If the particle diameter was excessively large, the rotation number of the mixture was increased to 14000 rpm and the stirring was continued for further 5 minutes. If it was excessively small, the rotation number of the mixture was decreased to 10000 rpm, and the stirring procedure was repeated. The resulting mixture was placed into a flask equipped with a thermometer and a paddle stirring bar that can stir at a peripheral speed of 5 m/s or more, was heated to 45° C. and was stirred at 6 m/s for 2 hours and thereby yielded elliptic base toner particles. To control the viscosity of the aqueous phase during stirring at 1000 to 5000 cP, a starch solution was added. If the particles did not have sufficiently elliptic shape, the stirring time was increased. After stirring, the solvent was removed at 50° C. or lower under reduced pressure over 1.0 hour, the residue was filtrated, washed, dried, subjected to air classification and thereby yielded elliptic base toner particles.

Next, 100 parts of the above-prepared base toner particles and 0.25 part of a charge control agent Bontron E-84 (trade name, available from Orient Chemical Industries, Ltd.) were mixed in a Q Mixer (trade name, available from Mitsui Mining Co., Ltd.) at a peripheral speed of a turbine blade of 50 m/sec. The mixing was performed for 2 minutes and stopped for 1 minute, and this cycle was repeated a total of five times. The total treating time was 10 minutes.

The product was further stirred with 0.5 part of a hydrophobic silica HDK H2000 (trade name, available from Clariant Japan Co., Ltd.) at a peripheral speed of 15 m/sec. The stirring was performed for 30 seconds and stopped for 1 minute, and this cycle was repeated five times to yield a toner. The toner was further mixed with 0.5 part of a hydrophobic silica and 0.5 part of hydrophobic titanium oxide in a Henschel Mixer and thereby yielded Toner 1 according to the present invention. The properties thereof are shown in Table 2.

EXAMPLE 2

Preparation Example 7

Preparation of Prepolymer

In a reactor equipped with a condenser, a stirrer and a nitrogen gas feed tube were placed 856 parts of ethylene oxide (2 mole) adduct of bisphenol A, 200 parts of isophthalic acid, 20 parts of terephthalic acid and 4 parts of dibutyltin oxide. The mixture was reacted at 250° C. at normal atmospheric pressure for 6 hours and was further reacted at a reduced pressure of 50 to 100 mmHg for 5 hours. After cooling to 160° C., the reaction mixture was further treated with 18 parts of trimellitic anhydride for 2 hours. After cooling to 80° C., the reaction mixture was treated with 17 parts of isophorone diisocyanate for 2 hours in ethyl acetate and thereby yielded Isocyanate-containing Prepolymer 2.

Preparation Example 8

Preparation of Toner

In a beaker were stirred and dissolved 15.4 parts of Prepolymer 2,50 parts of Unmodified Polyester 1 (PE 1) and 95.2 parts of ethyl acetate. The mixture was further stirred with 20 parts of carnauba wax (molecular weight: 1800, acid value: 2.5, penetration: 1.5 mm at 40° C.) and 7 parts of carbon black at 10000 rpm at 85° C. using a T. K. Homo Mixer (trade name, available from Tokushu Kika Kogyo Co., Ltd.), was then dispersed, emulsified and stirred using a bead mill by the procedure of Example 1 and thereby yielded base toner particles.

Toner 2 was then prepared by the procedure of Example 1, except for using these base toner particles and a charge control agent Bontron E-89 (trade name, available from Orient Chemical Co., Ltd.). The properties thereof are shown in Table 2.

EXAMPLE 3

Preparation Example 9

Preparation of Unmodified Polyester

Unmodified Polyester 2 (PE 2) was prepared by the procedure of Preparation Example 3, except that 589 parts of ethylene oxide (2 mole) adduct of bisphenol A, 464 parts of dimethyl terephthalate and 3 parts of dibutyltin oxide were polycondensed at 230° C. at normal atmospheric pressure for 6 hours and were reacted at a reduced pressure of 10 to 15 mmHg for 5 hours.

Preparation Example 10

Preparation of Toner

In a beaker were stirred and dissolved 15.3 parts of Prepolymer 1, 63.6 parts of Unmodified Polyester 2 (PE 2), 40 parts of toluene and 40 parts of ethyl acetate. The solution was stirred with 10 parts of rice wax and 7 parts of carbon black Regal 400R (trade name, available from Cabot Corp.) using a T. K. Homo Mixer (trade name, available from Tokushu Kika Kogyo Co., Ltd.) at 12000 rpm at 60° C. and was dispersed using a bead mill at 25° C. for 30 minutes. The mixture was further mixed with 1.1 parts of diphenylmethane diisocyanate as an elongation agent dissolved therein to yield Toner Material Solution 3.

Toner Material Solution 3 was treated in a beaker by the procedure of Example 1 with stirring at 12000 rpm using a T. K. Homo Mixer (trade name, available from Tokushu Kika Kogyo Co., Ltd.) for 10 minutes. The resulting mixture was placed into a flask equipped with a thermometer and a paddle stirring bar, was heated to 50° C. over 30 minutes for urethane reaction. The reacted dispersion was stirred using a T. K. Homo Mixer (trade name, available from Tokushu Kika Kogyo Co., Ltd.) at a peripheral speed of 20.5 m/s for 25 minutes. After stirring, the solvent was removed at 50° C. or lower, the residue was filtrated, washed, dried, subjected to air classification and thereby yielded elliptic base toner particles. Toner 3 was prepared by the procedure of Example 1, except for using the prepared base toner particles. The properties thereof are shown in Table 2.

EXAMPLE 4

Preparation Example 11

Preparation of Prepolymer

In a reactor equipped with a condenser, a stirrer and a nitrogen gas feed tube were placed 755 parts of ethylene oxide (2 mole) adduct of bisphenol A, 195 parts of isophthalic acid, 15 parts of terephthalic acid and 4 parts of dibutyltin oxide. The mixture was reacted at 220° C. at normal atmospheric pressure for 8 hours and was further reacted at a reduced pressure of 50 to 100 mmHg for 5 hours. After cooling to 110° C., the reaction mixture was further treated with 10 parts of trimellitic anhydride for 2 hours. After cooling to 80° C., the reaction mixture was treated with 170 parts of isophorone diisocyanate for 2 hours and thereby yielded Isocyanate-containing Prepolymer 3.

Preparation Example 12

Preparation of Toner

In a beaker were stirred and dissolved 15.4 parts of Prepolymer 3, 50 parts of Unmodified Polyester 1 (PE 1) and 95.2 parts of ethyl acetate. The solution was stirred with 20 parts of camauba wax (molecular weight: 1800, acid value: 2.5, penetration: 1.5 mm at 40° C.) and 7 parts of carbon black MOGUL L (trade name, available from Cabot Corp.) using a T. K. Homo Mixer (trade name, available from Tokushu Kika Kogyo Co., Ltd.) at 12000 rpm at 85° C. and was dispersed using a bead mill at 15° C. for 50 minutes and thereby yielded Toner Material Solution 4.

Toner Material Solution 4 was treated in a beaker by the procedure of Example 1 with stirring at 12000 rpm using a T. K. Homo Mixer (trade name, available from Tokushu Kika Kogyo Co., Ltd.) for 10 minutes. The mixture was treated with 2.7 parts of Ketimine Compound 1 for elongation reaction. The mixture was placed into a flask equipped with a thermometer and a paddle stirring bar, was stirred at 300 rpm at 40° C. for 2 hours and thereby yielded elliptic base toner particles. After stirring, the solvent was removed at 40° C. over 1 hour, the residue was filtrated, washed, dried, subjected to air classification and thereby yielded elliptic base toner particles. The emulsion in this procedure had a concentration of 13%. Toner 4 was prepared by the procedure of Example 1, except for using these prepared base toner particles. The properties thereof are shown in Table 2.

Comparative Example 1

Preparation of Toner Binder

A total of 395 parts of ethylene oxide (2 mole) adduct of bisphenol A and 166 parts of isophthalic acid were polycondensed by catalysis of 2 parts of dibutyltin oxide and thereby yielded Unmodified Polyester 3 (PE 3).

Preparation of Toner

In a beaker were stirred and homogeneously dispersed 100 parts of Unmodified Polyester 3 (PE 3), 180 parts of ethyl acetate, 4 parts of copper phthalocyanine blue pigment, a 10% hydroxyapatite suspension Supertite 10 (trade name, available from Nippon Chemical Industrial Co., Ltd.) and sodium dodecylbenzenesulfonate as dispersing agents at 10000 rpm at 50° C. using a T. K. Homo Mixer (trade name, available from Tokushu Kika Kogyo Co., Ltd.). Toner particles were prepared by the procedure of Example 1, except that the solvent was removed over 1 hour. A total of 100 parts of the toner particles was mixed with 0.3 part of hydrophobic silica and 0.3 parts of hydrophobic titanium oxide in a Henschel Mixer and thereby yielded Comparative Toner 1. The properties thereof are shown in Table 2.

Comparative Example 2

Preparation of Toner Binder

In a reactor equipped with a condenser, a stirrer and a nitrogen gas feed tube were reacted 343 parts of ethylene oxide (2 mole) adduct of bisphenol A, 166 parts of isophthalic acid and 2 parts of dibutyltin oxide at 230° C. at normal atmospheric pressure for 8 hours, followed by reaction at a reduced pressure of 10 to 15 mmHg for 5 hours. After cooling to 80° C., the reaction mixture was treated with 14 parts of toluene diisocyanate in toluene at 110° C. for 5 hours, followed by removal of the solvent to yield a urethane-modified polyester. Separately, an unmodified polyester (Unmodified Polyester 4 (PE 4)) was prepared by the polycondensation procedure of Example 1, except for using 363 parts of ethylene oxide (2 mole) adduct of bisphenol A and 166 parts of isophthalic acid. Comparative Toner Binder 2 was prepared by dissolving and mixing 350 parts of the urethane-modified polyester and 650 parts of the unmodified polyester in toluene and removing the solvent thereafter.

Preparation of Toner

A toner was prepared in the following manner. Initially, 100 parts of Comparative Toner Binder 2, 2 parts of chromium complex of salicylic acid Bontron E-81 (trade name, available form Orient Chemical Co., Ltd.) as a charge control agent and 4 parts of copper phthalocyanine blue pigment were premixed using a Henschel Mixer and were kneaded in a continuous kneader. After pulverizing in a jet-pulverizer, the product was classified in an air classifier and thereby yielded base toner particles. A total of 100 parts of the base toner particles was mixed with 0.3 part of hydrophobic silica and 0.3 part of hydrophobic titanium oxide using a Henschel Mixer and thereby yielded Comparative Toner 2. The properties thereof are shown in Table 2.

Comparative Example 3

| | |
|---|---|
| Polyester resin (bisphenol resin, Kao Corporation; Mn: 6000, Mw: 70000, Tg: 64° C.) | 90 parts |
| Carbon black BP 1300 (Cabot Corp.) | 10 parts |
| Rice wax (melting point: 82° C.) | 10 parts |
| Mixture of diethyl ether and dichloromethane (50:50) | 300 parts |

The above components were mixed and dispersed using a ball mill for 10 hours. The dispersion was poured into 400 parts of 2% aqueous solution of gum arabic and was dispersed for 3 minutes using a Homo Mixer. The resulting dispersion was poured into 2000 parts of pure water and was stirred by a Heiden Three-one Motor stirrer (trade name, available from Shinto Kagaku K.K.) at a constant temperature of 80° C. in a water bath for 4 hours and thereby yielded irregular particles having an average particle diameter of 6.0 μm and having depressions. The suspension in this stage was heated to 98° C., was held at the same temperature for 1 hour and thereby yielded spherical particles having the substantially the same particle diameter as above. The particles were mixed with a charge control agent in a Q mixer by the procedure of Example 1 and thereby yielded Comparative Toner 3. The properties thereof are shown in Table 2.

Comparative Example 4

| Mixing Step | |
|---|---|
| Styrene-n-butyl acrylate resin (copolymerization ratio 55:45, Mn: 3100, Mw: 8200, prepared by solution polymerization) | 90 parts |
| Carbon black (Cabot Corp.) | 5 parts |
| Polypropylene (Mitsui Chemicals, Inc., molecular weight: about 8000) | 5 parts |

The above components were kneaded in a Banbury mixer (available from Kobe Steel Ltd.) and thereby yielded a dispersion. A total of 100 parts of the dispersion was mixed with 400 parts of ethyl acetate and stirred at 20° C. for 2 hours and thereby yielded 500 parts of Toner Composition containing dissolved styrene-n-butyl acrylate resin.

| Dispersing-suspending Step | |
|---|---|
| Fine polymer particle (copolymer of styrene, methacrylic acid, butyl acrylate and sodium salt of ethylene oxide adduct of methacrylic acid sulfuric ester, particle diameter: 0.10 μm, Tg: 57° C.) | 22 parts |
| Carboxymethyl cellulose (etherification degree: 0.75, average polymerization degree: 850, Dai-ichi Kogyo Seiyaku Co., Ltd.) | 0.03 part |
| Ion-exchanged water | 99.97 parts |

The above components were dispersed in an ultrasonic disperser and thereby yielded an aqueous medium. A total of 100 parts of the Toner Composition was gradually added to 220 parts of the aqueous medium stirred at 10000 rpm by a homogenizer (available from Ika Works Inc.), followed by stirring for 2 minutes to yield 320 parts of a suspension.

Solvent Removing Step

The suspension prepared in the dispersing-suspending step was heated to 50° C. with stirring, was held at 50° C. for 3 hours and was cooled to room temperature.

Washing and Dewatering Step

To 200 parts of the fine particle suspension prepared in the solvent removing step was added 40 parts of 10 N hydrochloric acid, and the mixture was washed with ion-exchanged water four times by suction filtration.

Drying and Sieving Step

The fine particle cake prepared in the dewatering step was dried in a vacuum dryer and was sieved through a 45-μm mesh sieve.

External Additive Mixing Step

The external additive was mixed by the procedure of Example 1.

Determination Methods (1) Glass Transition Temperature Tg

The glass transition point Tg was determined in the following manner using a differential scanning calorimeter DSC-60 (trade name, available from Shimadzu Corporation).

About 5 mg of a test sample was placed in an aluminum sample vessel, and the sample vessel was placed on a holder unit and was placed in an electric furnace. In a nitrogen atmosphere, the test sample was heated from room temperature to 150° C. at a rate of 10° C./min and was cooled to room temperature at a rate of 10° C./min. The cooled test sample was again heated to 150° C. at a rate of 10° C./min and was subjected to differential scanning calorimetry (DSC) measurement. The DSC data was analyzed by DSC-60, and the glass transition point Tg was defined as the point of intersection of the tangent line of the endothermic curve in the vicinity of Tg and the base line.

(2) Acid Value

The acid value of a test sample was determined according to the method specified in Japanese Industrial Standards (JIS) K 0070. When the test sample was not dissolved in the specified solvent, dioxane or tetrahydrofuran was used as the solvent.

(3) Powder Flowability

The bulk density of a test sample was determined using a Powder Tester PT-R (trade name, available from Hosokawa Micron Corporation). A toner with a large bulk density has a large flowability. The flowability was evaluated according to the following criteria based on the bulk density.

Excellent: The bulk density is 0.35 or more.

Good: The bulk density is 0.30 or more and less than 0.35.

Fair: The bulk density is 0.25 or more and less than 0.30.

Failure: The bulk density is less tan 0.25.

(4) High-temperature Storage Stability

A sample toner was stored at 50° C. for 8 hours, followed by sieving through a 42-mesh sieve for 2 minutes. The high-temperature storage stability of the sample toner was determined as the ratio of the sample remaining on the mesh (residual ratio) according to the following criteria. A toner with small residual ratio has large storage stability at high temperatures.

Excellent: The residual ratio is less than 10%.

Good: The residual ratio is 10% or more and less than 20%.

Fair: The residual ratio is 20% or more and less than 30%.

Failure: The residual ratio is 30% or more.

(5) Lowest Fixing Temperature

A copying test was carried out on Type 6200 Paper (trade name, available from Ricoh Company Limited) using a modified IMAGIO NEO 450 copier (trade name, available from Ricoh Company Limited) as a fixing roller device. The lowest fixing temperature (° C.) was defined as a temperature of the fixing roller at which a remaining rate of the image density of a fixed image was 70% or more after rubbing the fixed image with a pad.

The fixing device of the copier was modified so that the metal cylinder of its fixing roller comprised an iron cylinder with a thickness of 0.34 mm. The contact pressure was set at $1.0\times10^5$ Pa.

(6) Hot Offset Occurring Temperature (HOT)

The image fixing procedure of the above lowest fixing temperature test was performed, and occurrence of hot offset to the fixed image was visually observed. The hot offset occurring temperature was defined as a temperature of the fixing roller at which hot offset occurred.

(7) Charging Stability

The amounts of charge of a toner at (1) low temperature and low humidity and (2) at high temperature and high humidity were determined by a blow-off method, and the difference of the amounts of charge was determined. More specifically, a developer was prepared using a test sample toner and an iron powder coated with a silicone resin as a carrier, and the charge of the developer was determined at 10° C. at RH of 30%, or at 30° C. at RH of 90%. A toner with a small difference in charge has a large charging stability.

Excellent: The difference in charge is small and the charging ability is stable.

Good: The difference in charge is somewhat large.

Fair: The difference in charge is large.

Failure: The difference in charge is too large to use.

(8) Cleaning Ability

The surface of a latent image bearing member immediately after cleaning by a cleaning blade was visually observed, and a toner adhered to the surface was taken to a transparent tape, the tape was attached to white paper, and the density was determined from above using a Macbeth densitometer.

(9) Contrast

The contrast was determined using a 10-step gradation chart.

Determination of Recycling Ability

Preparation of Developer

A developer was prepared by mixing and sufficiently shaking 50 parts of a classified sample toner having a particle diameter of 10 to 11 μm and 950 parts of a carrier (core carrier: 70 μm ) coated with a silicone resin KR 250 (trade name, available from Shin-Etsu Chemical Co., Ltd.). A total of $1\times10^5$ copies was produced using the developer and a modified copier IMAGIO NEO 450 having a toner recycling system, and images were evaluated in the following manner.

(10) Content of Fine Powder

After producing $1\times10^5$ copies as above, the particle distribution of the sample toner was determined using a Coulter Counter Model TA-2 (trade name, available from Coulter Electronics, Inc.). In this procedure, a 1% aqueous solution of NaCl and Drywell (trade name, available from Fuji Photo Film Co., Ltd.) were used as an electrolyte and a dispersing agent, respectively. The particle distribution was output through a computer, and the percentage by number of fine powders having a particle diameter of 5.04 μm or less was determined.

(11) Toner Aggregation

A toner was sampled from the development device after producing $1\times10^5$ copies, and aggregates of the toner were observed. The toner aggregation was determined according to the following criteria.

Good: The toner contains substantially no aggregate.

Fair: The toner contains some aggregates but reaches practical levels.

Failure: The toner contains a lot of aggregates and does not reach practical levels.

(12) Toner Flowability

A toner was sampled from the development device after producing $1\times10^5$ copies, and the flowability of the toner was determined by visual observation according to the following criteria.

Good: The flowability of the toner is good.

Fair: The flowability of the toner is somewhat poor but reaches practical levels.

Failure: The flowability of the toner is poor and does not reach practical levels.

(13) Toner Durability

The image density of a solid image after producing $1\times10^5$ copies was compared with the image density of the solid image at the beginning of copying. The durability of the toner was determined according to the following criteria.

Good: The image density decreases little and a clear image is reproduced even after producing $1\times10^5$ copies.

Fair: The image density decreases but reaches practical levels.

Failure: The image density decreases and does not reach practical levels.

(14) Toner Deposition on Background

In the toner durability test, the level of toner deposition on the background of images was determined according to the following criteria.

1: There is no toner deposition on the background, and the image is clear.

2: There is some toner deposition on the background but it is acceptable as image quality.

3: There is significant toner deposition on the background and it is not acceptable as image quality.

(15) Irregular Image

In the toner durability test, irregular images such as black spots, blur (fading), and deposition of carrier were observed.

TABLE 1

| | Unmodified polyester | Prepolymer | Acid value | Tg (° C.) | Preparation |
|---|---|---|---|---|---|
| Example 1 | PE 1 | Prepolymer 1 | 8 | 55 | |
| Example 2 | PE 1 | Prepolymer 2 | 9 | 58 | |
| Example 3 | PE 2 | Prepolymer 1 | 16 | 48 | |
| Example 4 | PE 1 | Prepolymer 3 | 13 | 49 | |
| Comp. Ex. 1 | PE 3 | — | 35 | 72 | dissolution suspension |
| Comp. Ex. 2 | PE 4 | Urethane-modified | 14 | 75 | pulverization |
| Comp. Ex. 3 | Polyester | — | 12 | 58 | dissolution suspension |
| Comp. Ex. 4 | Styrene-acrylic copolymer | — | 2.5 | 51 | dissolution suspension |

Note:

Acid values and Tg values are those of the unmodified polyesters and styrene-acrylic copolymer (in the column "Unmodified polyester").

TABLE 2-1

| | SF-1 | Sphericity | Dv/Dn | Dv (μm) | Percentage of particles of 2 μm or less | Lowest fixing temperature (° C.) | HOT (° C.) | Charging stability | High-temperature storage stability | Powder flowability |
|---|---|---|---|---|---|---|---|---|---|---|
| Example 1 | 155 | 0.94 | 1.15 | 4.7 | 5.5 | 150 | 220 | Good | Good | Excellent |
| Example 2 | 195 | 0.92 | 1.26 | 5.5 | 20.0 | 150 | 220 | Good | Excellent | Excellent |
| Example 3 | 171 | 0.94 | 1.14 | 4.9 | 7.5 | 160 | 230 | Good | Excellent | Good |
| Example 4 | 165 | 0.93 | 1.05 | 4.1 | 5.0 | 140 | 220 | Good | Good | Good |
| Comp. Ex. 1 | 115 | 0.97 | 1.38 | 7.0 | 18.0 | 175 | 210 | Failure | Good | Good |
| Comp. Ex. 2 | 160 | 0.94 | 1.45 | 5.5 | 23.0 | 185 | 195 | Good | Good | Failure |
| Comp. Ex. 3 | 125 | 0.97 | 1.15 | 6.8 | 11.5 | 160 | 180 | Good | Fair | Fair |
| Comp. Ex. 4 | 140 | 0.95 | 1.06 | 4.8 | 6.8 | 165 | 185 | Good | Fair | Failure |

TABLE 2-2

| | Fine powder content (%) | Toner aggregation | Toner durability | Toner flowability | Toner deposition | Irregular images and other conditions | Cleaning ability | Contrast |
|---|---|---|---|---|---|---|---|---|
| Example 1 | 18 | Good | Good | Good | 1 | none | 0.04 | 8 |
| Example 2 | 16 | Good | Good | Fair | 1 | none | 0.1 | 9 |
| Example 3 | 24 | Good | Good | Good | 2 | none | 0.03 | 8 |
| Example 4 | 15 | Good | Good | Good | 1 | none | 0.08 | 10 |
| Comp. Ex. 1 | 38 | Fair | Failure | Good | 3 | cleaning failure | 0.2 | 7 |
| Comp. Ex. 2 | 20 | Failure | Failure | Fair | 2 | none | 0.05 | 8 |

TABLE 2-2-continued

| | Fine powder content (%) | Toner aggregation | Toner durability | Toner flowability | Toner deposition | Irregular images and other conditions | Cleaning ability | Contrast |
|---|---|---|---|---|---|---|---|---|
| Comp. Ex. 3 | 32 | Fair | Fair | Fair | 1 | cleaning failure | 0.15 | 9 |
| Comp. Ex. 4 | 16 | Failure | Good | Fair | 3 | none | 0.1 | 9 |

The toners of Comparative Examples 2 and 4 have a small average particle diameter, form a large amount of aggregates, show poor flowability and thereby invite toner deposition on the background of images.

The toners of Comparative Examples 1, 2 and 4 have a low shape factor SF-1, are substantially spherical and show insufficient cleaning ability in blade cleaning.

The toners of Comparative Examples 1 and 2 have high glass transition points Tg and show high lowest fixing temperatures.

The toner of Comparative Example 3 has irregular shapes with depressions and protrusions, contains a large amount of fine powder and exhibits inferior toner aggregation, durability, flowability and cleaning ability.

The toner of Comparative Example 4 comprises a styrene-acrylic copolymer and has a high lowest fixing temperature in spite of its small average particle diameter.

In contrast, the toners of Examples 1 to 4 do not invite generation of toner fine powder in the apparatus, show no problem in image and toner scattering in the apparatus. In particular, they have a high shape factor SF-1 and exhibit excellent cleaning ability in blade cleaning.

However, the properties of the toner of Example 2 show that an excessively high shape factor SF-1 may induce fine powder and slightly low cleaning ability.

The properties of the toner of Example 4 show that a small average particle diameter and a sharp particle distribution, namely, a small ratio Dv/Dn yields good image-fixing properties and high contrast.

As is described in detail above, the toner of the present invention has the following advantages.

Specifically, the toner of the present invention can be recycled satisfactorily, does not invite decreased charge due to bleed out of a wax or decreased sharpness of images due to toner aggregation, invites less residual toner after transfer in an apparatus using blade cleaning and can yield high-quality images.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A toner for use in an image forming process, comprising:

a modified polyester resin;

a coloring agent;

a releasing agent; and a coating, wherein the toner has a volume-average particle diameter Dv, a number-average particle diameter Dn and a shape factor SF-1, wherein Dv is in a range of from 4.0 μm to 6.0 μm, the ratio Dv/Dn of Dv to Dn is in a range of from 1.00 to 1.30, and the shape factor SF-1 is in a range of from 140 to 200, and wherein the toner can be used in a toner recycling system.

2. A toner according to claim 1, wherein the toner is produced by a process comprising the steps of:

dissolving or dispersing a composition in an organic solvent to form a solution or dispersion, the composition comprising a resin reactive with a compound having an active hydrogen group, a coloring agent and a releasing agent;

dispersing the solution or dispersion in an aqueous medium during at least one of elongation and crosslinking reactions of the resin thereby forming a reacted dispersion; and removing the organic solvent after or during at least one of the elongation and crosslinking reactions of the resin.

3. A toner according to claim 2, wherein the composition further comprises a compound having an active hydrogen group.

4. A toner according to claim 2, wherein the process further comprises the step of adding a compound having an active hydrogen group during the step of dispersing the solution or dispersion in the aqueous medium.

5. A toner according to claim 2, wherein the aqueous medium comprises fine polymer particles, wherein the fine polymer particles are capable of forming a coating.

6. A toner according to claim 5, wherein the fine polymer particles have a glass transition point Tg of from 50° C. to 110° C.

7. A toner according to claim 5, wherein the fine polymer particles comprise at least one resin selected from the group consisting of vinyl resins, polyurethane resins, epoxy resins, polyester resins, polyamide resins, polyimide resins, silicone resins, phenolic resins, melamine resins, urea resins, aniline resins, ionomer resins, and polycarbonate resins.

8. A toner according to claim 5, wherein the fine polymer particles have a volume average particle diameter of from 10 nm to 200 nm.

9. A toner according to claim 2, wherein the process further comprises the step of agitating the reacted dispersion in an agitation vessel with an agitator having a peripheral speed of 5 m/s or more to convert spherical particles into elliptic particles before the step of removing the organic solvent.

10. A toner according to claim 1, wherein the ratio Dv/Dn is from 1.00 to 1.20.

11. A toner according to claim 1, wherein the shape factor SF-1 is from 150 to 180.

12. A toner according to claim 1, wherein the content percentage of particles having a diameter of 2 μm or less in a particle diameter distribution determined with a flow particle image analyzer is 15% by number or less.

13. A toner according to claim 1, having an average sphericity of from 0.90 to 0.95 as determined with a flow particle image analyzer.

14. A toner according to claim 1, wherein the modified polyester resin is a urea-modified polyester resin.

15. A toner according to claim 1, further comprising an unmodified polyester resin.

16. A toner according to claim 15, wherein the unmodified polyester resin has a glass transition point Tg of from 40° C. to 70° C.

17. A toner according to claim 15, wherein the unmodified polyester resin has an acid value of from 1 mg-KOH/g to 30 mg-KOH/g.

18. A toner according to claim 1, which is used in a two-component developer.

19. A two-component developer for use in an image forming process, comprising:

a toner; and a carrier, wherein the toner contains:

a modified polyester resin;

a coloring agent;

a releasing agent; and a coating, the toner having a volume-average particle diameter Dv, a number-average particle diameter Dn, and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200, and wherein the developer can be used in a toner recycling system.

20. An image forming apparatus, comprising:

a photoconductor;

a charger for charging the photoconductor;

an exposer for exposing the photoconductor to light to form a latent electrostatic image;

a developing unit containing a toner and serving for developing the latent electrostatic image using the toner to form a toner image;

a transferring unit for transferring the toner image from the photoconductor to a transfer material; and a cleaner for cleaning a residual toner on the surface of the photoconductor with a blade after transfer, wherein the toner contains:

a modified polyester resin;

a coloring agent;

a releasing agent; and a coating, the toner having a volume-average particle diameter Dv, a number-average particle diameter Dn, and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200.

21. An image forming apparatus according to claim 20, wherein the photoconductor is an amorphous silicon photoconductor.

22. An image forming apparatus according to claim 20, wherein the developing unit has an alternating electric field applying unit for applying an alternating electric field upon development of the latent electrostatic image on the photoconductor.

23. An image forming apparatus according to claim 20, wherein the charger comprises a charging member and the charger is so configured as to bring the charging member into contact with the photoconductor and apply a voltage to the charging member to thereby charge the photoconductor.

24. A process cartridge, integrally comprising:

a photoconductor; and at least one selected from the group consisting of:

a charger for charging the photoconductor;

a developing unit containing a toner and serving for developing a latent electrostatic image using the toner to form a toner image; and a cleaner for cleaning a residual toner on the photoconductor with a blade after transfer, the process cartridge being detachable from and attachable to a main body of an image forming apparatus, wherein the toner contains:

a modified polyester resin;

a coloring agent;

a releasing agent; and a coating, the toner having a volume-average particle diameter Dv, a number-average particle diameter Dn and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200.

25. An image forming process, comprising the steps of:

charging a photoconductor;

exposing the photoconductor to light to form a latent electrostatic image;

developing the latent electrostatic image using a toner to form a toner image;

transferring the toner image from the photoconductor to a transfer material; and cleaning a residual toner on the photoconductor with a blade after transferring, wherein the toner contains:

a modified polyester resin;

a coloring agent;

a releasing agent; and a coating, the toner having a volume-average particle diameter Dv, a number-average particle diameter Dn and a shape factor SF-1, wherein Dv is in a range from 4.0 μm to 6.0 μm, the ratio Dv/Dn of Dv to Dn is in a range from 1.00 to 1.30, and the shape factor SF-1 is in a range from 140 to 200.

26. A toner for use in an image forming process, comprising:

a modified polyester resin;

a coloring agent;

a release agent; and a plurality of fine polymer particles, wherein the surface of the toner is coated with the plurality of fine polymer particles, wherein the toner has a volume-average particle diameter Dv, a number-average particle diameter Dn and a shape factor SF-1, wherein Dv is in a range of from 4.0 μm to 6.0 μm, the ratio Dv/Dn of Dv to Dn is in a range of from 1.00 to 1.30, and the shape factor SF-1 is in a range of from 140 to 200, and wherein the toner can be used in a toner recycling system.

* * * * *